US012553222B2

(12) United States Patent
Hankland et al.

(10) Patent No.: US 12,553,222 B2
(45) Date of Patent: Feb. 17, 2026

(54) WEAR ASSEMBLY, DIGGING EDGE AND INSERTS FOR EARTH WORKING EQUIPMENT

(71) Applicant: ESCO GROUP LLC, Portland, OR (US)

(72) Inventors: Joel S. Hankland, Canby, OR (US); Bruce C. Bingham, West Linn, OR (US); Scott H. Zenier, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 702 days.

(21) Appl. No.: 17/588,083

(22) Filed: Jan. 28, 2022

(65) Prior Publication Data

US 2022/0243428 A1 Aug. 4, 2022

Related U.S. Application Data

(60) Provisional application No. 63/143,046, filed on Jan. 29, 2021.

(51) Int. Cl.
*E02F 9/28* (2006.01)

(52) U.S. Cl.
CPC ..... *E02F 9/2825* (2013.01); *E02F 9/2833* (2013.01); *E02F 9/2858* (2013.01); *E02F 9/2883* (2013.01)

(58) Field of Classification Search
CPC ..... E02F 9/2825; E02F 9/2858; E02F 9/2883; E02F 9/2833; E02F 9/28
See application file for complete search history.

(56) References Cited

U.S. PATENT DOCUMENTS

| | | | |
|---|---|---|---|
| 1,775,984 A | 9/1930 | Younie | |
| 3,388,488 A | 6/1968 | Duplessis | |
| 3,440,745 A | 4/1969 | Olof | |
| 3,736,664 A | 6/1973 | Black et al. | |
| 3,947,982 A | 4/1976 | Mantovani | |
| 4,414,764 A | 11/1983 | Johansson et al. | |
| 4,932,145 A | 6/1990 | Reeves, Jr. | |

(Continued)

FOREIGN PATENT DOCUMENTS

| | | | | |
|---|---|---|---|---|
| SU | 1146442 A1 * | 3/1985 | | |
| WO | WO-2007027639 A2 * | 3/2007 | ..... | E02F 9/28 |
| WO | WO-2008025062 A1 * | 3/2008 | ..... | E02F 9/2825 |

OTHER PUBLICATIONS

"CR's Berkeley Forge Range—Electric Rope Shovels", CR Powered by Epiroc, Sep. 14, 2020, https://www.youtube.com/watch?v=VCItMCGAHUY.

(Continued)

*Primary Examiner* — Christopher J Sebesta
*Assistant Examiner* — Blake E Scoville
(74) *Attorney, Agent, or Firm* — Palmer Dzurella

(57) ABSTRACT

A wear assembly for attaching a wear member to a base, wherein the wear member includes a pair of legs to straddle the base and a bight portion between the legs. The bight portion includes two rearwardly-converging side surfaces and a central surface extending therebetween. The central surface may have a non-linear extension between the side surfaces and/or a curved profile in a perpendicular direction that is defined by at least two different radii of curvature.

51 Claims, 21 Drawing Sheets

(56) References Cited

U.S. PATENT DOCUMENTS

| | | | | |
|---|---|---|---|---|
| 5,283,965 | A | 2/1994 | Clendenning | |
| 5,553,409 | A | 9/1996 | Irving | |
| 5,653,048 | A * | 8/1997 | Jones | E02F 9/2841 37/450 |
| 6,729,052 | B2 * | 5/2004 | Ollinger, IV | E02F 9/2841 403/374.4 |
| 6,986,216 | B2 * | 1/2006 | Emrich | H03K 19/0019 37/450 |
| 7,036,249 | B2 * | 5/2006 | Mautino | E02F 9/2825 37/457 |
| 7,165,347 | B2 | 1/2007 | Ollinger, IV et al. | |
| 7,171,771 | B2 | 2/2007 | Briscoe | |
| 7,266,914 | B2 | 9/2007 | Grant | |
| 7,299,570 | B2 | 11/2007 | Emrich et al. | |
| 7,451,558 | B2 | 11/2008 | Jones | |
| 7,536,811 | B2 * | 5/2009 | McClanahan | E02F 9/2833 37/456 |
| 7,730,645 | B2 | 6/2010 | Ollinger, IV | |
| 7,730,651 | B2 | 6/2010 | Carpenter | |
| 8,024,874 | B2 * | 9/2011 | McClanahan | E02F 9/2883 37/446 |
| 8,578,637 | B2 | 11/2013 | Ollinger, IV et al. | |
| 8,819,967 | B2 * | 9/2014 | Campomanes | E02F 9/2883 37/453 |
| 8,925,220 | B2 * | 1/2015 | Stangeland | E02F 9/2825 37/452 |
| 9,404,240 | B2 | 8/2016 | Kunz | |
| 9,409,258 | B2 * | 8/2016 | Ruvang | B23K 31/02 |
| 9,605,416 | B2 * | 3/2017 | Campomanes | E02F 9/2825 |
| 9,963,857 | B2 | 5/2018 | Ruvang | |
| 10,196,798 | B2 | 2/2019 | Campomanes et al. | |
| 10,513,837 | B2 * | 12/2019 | Campomanes | E02F 9/24 |
| 10,519,632 | B2 * | 12/2019 | Campomanes | E02F 9/2883 |
| 10,590,633 | B2 | 3/2020 | Kunz | |
| 11,066,812 | B2 * | 7/2021 | Jakubisin | E02F 9/2833 |
| 2004/0216334 | A1 * | 11/2004 | Emrich | E02F 9/2883 37/452 |
| 2008/0005940 | A1 * | 1/2008 | Ollinger | E02F 9/2866 37/452 |
| 2011/0252672 | A1 * | 10/2011 | Briscoe | E02F 9/2841 37/456 |
| 2015/0089848 | A1 * | 4/2015 | Stangeland | E02F 9/2883 37/455 |
| 2015/0121729 | A1 * | 5/2015 | Kunz | E02F 9/2883 37/451 |
| 2017/0321396 | A1 * | 11/2017 | Zenier | E02F 9/2883 |
| 2020/0232193 | A1 | 7/2020 | Amat Holgado et al. | |

OTHER PUBLICATIONS

ESCO Group LLC, "Three photographs taken in Canada in 2019 of an ESCO Whisler Plus lip that has recesses along the leading edge to receive a portion of the mounted shrouds" (2019).

ESCO Group LLC, a portion of a leading edge of a ESCO Whisler Plus lip in use prior to Jan. 29, 2021.

ESCO Group LLC, "Installation of leading edge inserts into an ESCO Whisler Plus lip for the mounting of adapters." (2011).

* cited by examiner

WEAR ASSEMBLY, DIGGING EDGE AND INSERTS FOR EARTH WORKING EQUIPMENT

RELATED APPLICATIONS

This application claims the benefit of priority from U.S. Provisional Patent Application No. 63/143,046 filed Jan. 29, 2021, the entirety of which is incorporated by reference.

FIELD OF DISCLOSURE

This disclosure is generally directed to a wear assembly, digging edge and/or inserts for earth working equipment.

BACKGROUND OF THE DISCLOSURE

It is a common practice to secure wear members (e.g., teeth and shrouds) along the digging edge of a bucket or other equipment. As can be appreciated, the wear members are often placed in harsh working conditions where they are subjected to heavy loading and abrasive environments. To mitigate damage and/or wear to the digging edge as well as perform other functions (e.g., easing penetration, gathering material, etc.), replaceable wear members are commonly provided.

Such wear members may be composed of multiple parts including, for example, an adapter, a point, and a lock. Mechanically attached adapters are commonly used for easier replacement. Examples include conventional Whisler adapters and other Whisler-style adapters (e.g., as shown in U.S. Pat. No. 7,299,570). In certain applications, the adapter has a rear mounting end with bifurcated legs to straddle the digging edge, and a forwardly projecting nose for mounting the point. Points are provided with a forward earth-penetrating end and a rearwardly-opening socket that receives the adapter nose. The lock is fit within the wear assembly to hold the point to the adapter.

SUMMARY OF THE DISCLOSURE

The present disclosure relates to the securing of wear members to earth working equipment.

In one example, a wear member for earth working equipment includes at least one leg and a mounting configuration to define a cavity to receive a base of the earth working equipment. The at least one leg extends rearwardly over the base, and the mounting configuration is proximate a front of the cavity to bear against a complementary support of the base on which the wear member is mounted. The mounting configuration includes a pair of laterally-spaced side bearing surfaces and a rear bearing surface extending between the side bearing surfaces, and the rear bearing surface is concave in a side-to-side direction between the side bearing surfaces.

In another example, a wear member for earth working equipment includes at least one leg and a mounting configuration defining a cavity to receive a base of the earth working equipment. The at least one leg extends rearwardly over the base, and the mounting configuration is proximate a front of the cavity to bear against a complementary support of the base on which the wear member is mounted. The mounting configuration includes a rear bearing surface curved in a vertical direction away from the at least one leg to define a curved upper profile and a curved lower profile, and one of the upper or lower profiles has a tighter curvature than the other of the upper or lower profiles.

In another example, a wear member for earth working equipment including at least one leg and a mounting configuration defining a cavity for receiving a base of the earth working equipment. The at least one leg extends rearwardly over the base, and the mounting configuration at a front of the cavity to bear against a complementary support structure of the base on which the wear member is mounted. The mounting configuration includes a pair of side bearing surfaces and a rear bearing surface, the side bearing surfaces converge toward each other so as to face generally in both a rear direction and a transverse direction, and the rear bearing surface faces generally in a rear direction and has a non-linear configuration.

In another example, a wear member includes a rear-facing mounting configuration to bear against the support structure on which the wear member is mounted. The rear-facing configuration includes outward-facing side bearing surfaces and a rearward-facing central surface extending between the side bearing surfaces. The central surface has a non-linear side-to-side shape.

In another example, a wear member includes a rear-facing mounting configuration to bear against the support structure on which the wear member is mounted. The rear-facing configuration includes outward-facing side bearing surfaces and a rearward-facing central surface extending between the side bearing surfaces. The central surface includes a plurality of different curvatures in a direction transverse to the side-to-side extension of the central surface between the side surfaces.

In one example, a wear member includes two inclined surfaces sized and shaped to mate with an insert in a digging edge having rearwardly converging inner surfaces of protruding arms of the leading surface of a digging edge.

In another example, a digging edge of an earth working equipment including an inner surface, an outer surface, a leading surface, and a support proximate the leading surface for bearing against a wear member mounted on the digging edge. The support includes two converging lateral bearing surfaces and a forwardly-facing front bearing surface. The front bearing surface has a convex shape in a side-to-side direction.

In another example, a digging edge of an earth working equipment includes an inner surface, an outer surface, a leading surface, and a support structure proximate the leading surface for bearing against a wear member mounted on the digging edge. The support structure including a front bearing surface that is curved in a direction from the inner surface to the outer surface so as to define a curved upper profile and a curved lower profile, wherein one of the upper or lower profiles has a tighter curvature than the other of the upper or lower profile.

In another example, a digging edge of an earth working equipment including an inner surface, an outer surface, a leading surface, and a support proximate the leading surface for bearing against a wear member mounted on the digging edge. The support including a front bearing surface that is curved in a direction from the inner surface to the outer surface so as to define a curved upper profile and a curved lower profile, wherein one of the upper or lower profiles has a tighter curvature than the other of the upper or lower profile.

In another example, an insert is installed onto a digging edge. The insert includes a main body and two projecting arms. The main body and/or projecting arms may include a curved surface in a direction transverse to the digging edge, wherein the curved surface is defined by at least two radii.

In another example, an insert is installed onto a digging edge. The insert includes a main body and two projecting arms. A front surface of the main body of the insert is non-linear in the direction extending between the two arms.

In another example, a mounting portion of a digging edge for mounting a wear member includes a leading surface having two rearwardly converging inner surfaces and a central surface extending therebetween. The central surface has a curved surface in a direction transverse to the digging edge that is defined by at least two different radii.

In another example, a mounting portion of a digging edge for mounting a wear member includes a leading surface having two rearwardly converging inner surfaces and a central surface extending therebetween, wherein the central surface is non-linear in the direction extending between the two arms.

In another example, a leading surface of a digging edge includes two projecting arms each of which includes an inner surface to bear against and laterally support a wear member secured to the digging edge. A central bearing surface extends between the two inner surfaces that has a curved convex configuration in a side-to-side direction. The origin of the radius defining the convex configuration is located within or rearward of the through-hole to receive the lock securing the wear member to the digging edge.

In another example, a leading surface of a digging edge includes two projecting arms each of which includes an inner surface to bear against and laterally support a wear member secured to the digging edge. The inner surfaces converge in a rearward direction at an angle where extensions of the two inner surfaces intersect the through-hole receiving the lock securing the wear member to the digging edge.

In another example, a wear assembly includes an adapter having a pair of rearwardly extending bifurcated legs that each includes an inner surface to face the digging edge. The inner surfaces are joined by a bight portion, which includes a central surface extending between two rearwardly converging surfaces. At least one of the legs may include a rear formation that contacts a boss for support and/or stabilization.

In another example, a wear member for earth working equipment includes a pair of spaced apart legs defining a cavity therebetween wherein each of the legs extends rearwardly over a base of the earth working equipment, and a rear-facing mounting configuration extending between the legs at the front of the cavity to bear against a complementary support structure of the base on which the wear member is mounted. The mounting configuration includes a pair of laterally-spaced side bearing surfaces and a central bearing surface extending between the side bearing surfaces. Each of the side bearing surfaces is laterally inclined to face outward and rearward.

In another example, a wear member for earth working equipment includes a pair of spaced apart legs defining a cavity therebetween wherein each of the legs extends rearwardly over a base of the earth working equipment, and a rear-facing mounting configuration extending between the legs at the front of the cavity to bear against a complementary support structure of the base on which the wear member is mounted. The mounting configuration includes a pair of laterally-spaced side bearing surfaces and a central bearing surface extending between the side bearing surfaces. The central bearing surface is curved in a direction from one of the legs to the other leg so as to define an upper curved profile and a lower curved profile, wherein the upper profile has a different radius of curvature than the lower profile.

In another example, a wear member for earth working equipment includes a pair of spaced apart legs defining a cavity therebetween wherein each of the legs extends rearwardly over a base of the earth working equipment, and a rear-facing mounting configuration extending between the legs at the front of the cavity to bear against a complementary support structure of the base on which the wear member is mounted. The mounting configuration includes a pair of laterally-spaced side bearing surfaces and a central bearing surface extending between the side bearing surfaces, wherein the central bearing surface has a non-linear side-to-side shape between the side bearing surfaces.

In another example, a digging edge of an earth working equipment includes an inner surface, an outer surface and a leading surface. The leading surface includes a support structure for bearing against a wear member mounted on the digging edge. The support structure includes two rearwardly converging inner bearing surfaces and a central bearing surface extending between the inner bearing surfaces, wherein the central bearing surface is non-linear in a side-to-side direction extending between the inner bearing surfaces.

In another example, a digging edge of an earth working equipment includes an inner surface, an outer surface and a leading surface. The leading surface includes a support structure for bearing against a wear member mounted on the digging edge. The support structure includes two rearwardly converging inner bearing surfaces and a central bearing surface extending between the inner bearing surfaces. The central bearing surface is curved in a direction from the inner surface to the outer surface so as to define an upper curved profile and a lower curved profile, wherein the upper profile has a different radius of curvature than the lower profile.

In another example, a digging edge assembly for earth working equipment including a digging edge, a wear member and a retainer. The digging edge including an inner surface, an outer surface, a leading surface, and a support proximate the leading surface. The support including two converging lateral bearing surfaces and a front bearing surface, wherein the lateral bearing surfaces converge toward each other so as to face generally in both a front direction and a transverse direction, and the front bearing surface is convex in a side-to-side direction. The wear member including a pair of spaced apart legs defining a cavity therebetween that receive the digging edge, each of the legs extending rearwardly over the digging edge, and a mounting configuration proximate a front of the cavity to bear against the support. The mounting configuration includes a pair of side bearing surfaces to bear against the lateral bearing surfaces and a rear bearing surface to bear against the front bearing surface, the side bearing surfaces converge toward each other so as to face generally in both a rear direction and a transverse direction, and the rear bearing surface faces generally in a rear direction and has a concave configuration. The retainer secures the wear member to the digging edge.

In another example, an insert for installation onto a digging edge of a bucket for earth working equipment includes a main body and two projecting arms, wherein a front surface of the main body is non-linear in a side-to-side direction extending between the two arms.

These and other aspects will be apparent from the following specific description, given by way of example only, with reference to the accompanying drawings.

DETAILED DESCRIPTION OF PREFERRED EXAMPLES

Figure 1:
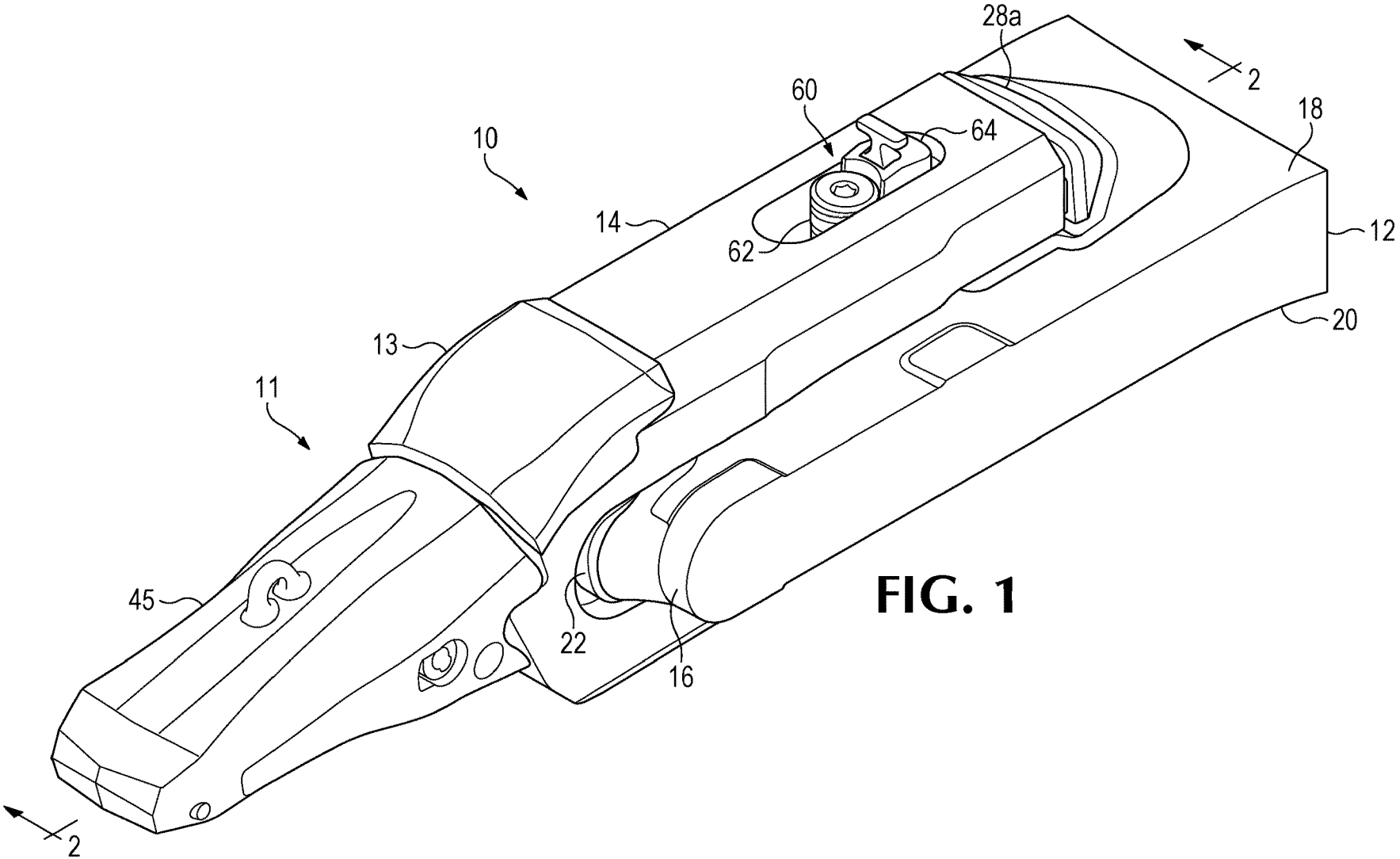
FIG. 1 is a perspective view of a wear assembly in accordance with the present disclosure with a portion of the lip.
Figure 2:
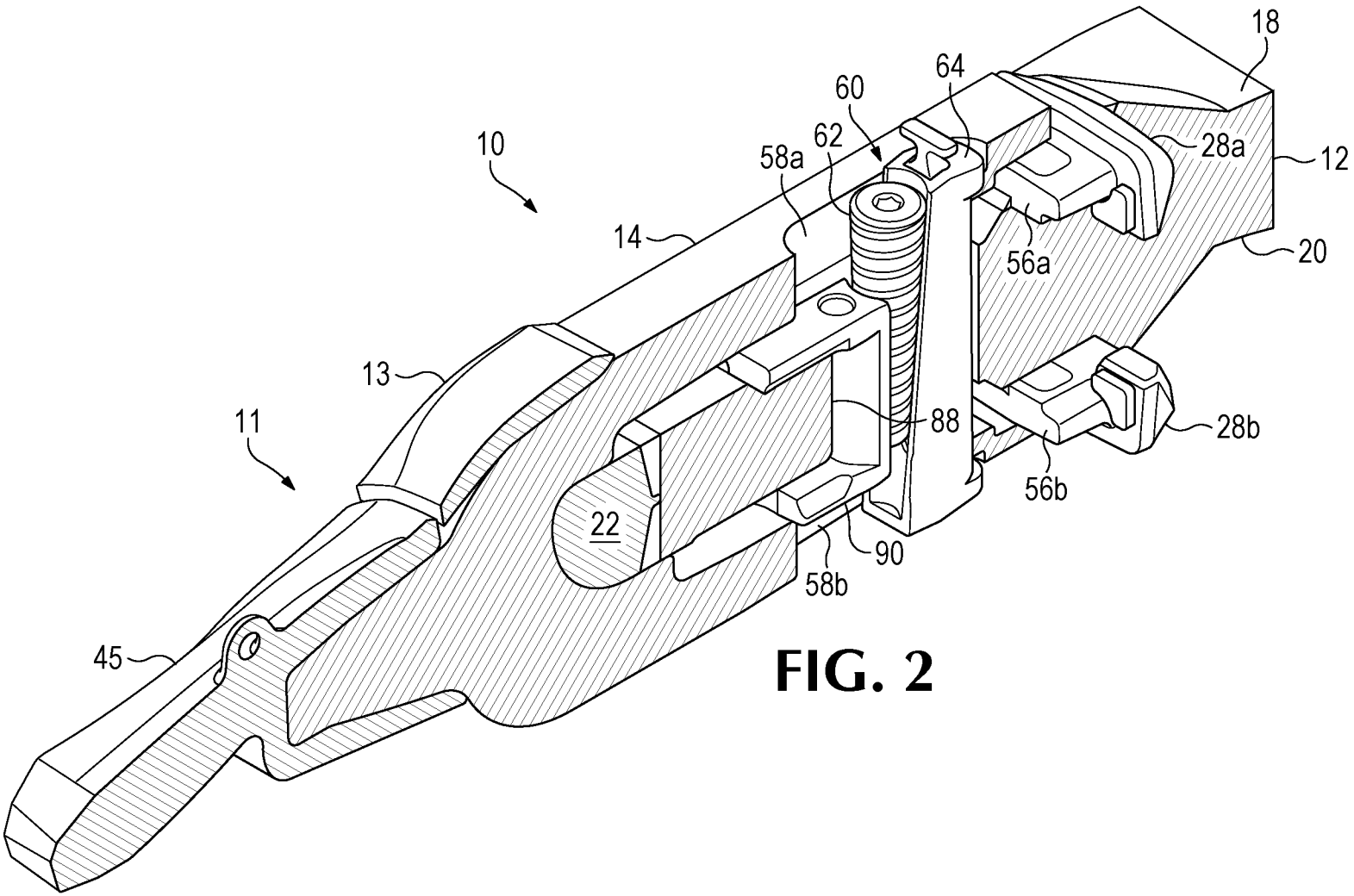
FIG. 2 is a cross-sectional view taken along line 2-2 in FIG. 1.
Figure 3:
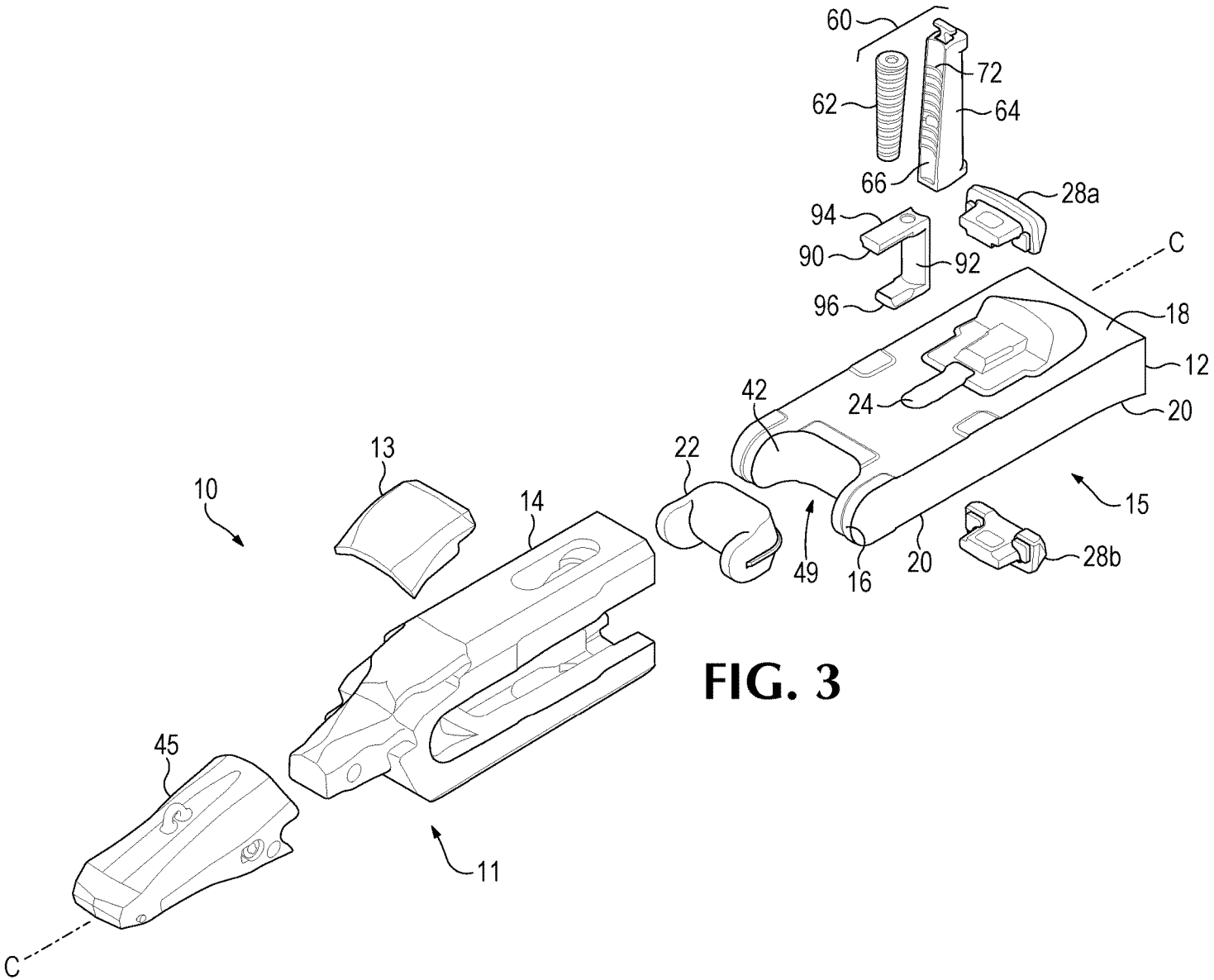
FIG. 3 is an exploded view of the wear assembly and lip of FIG. 1.

In the example of FIGS. 1-3, a wear assembly 10 includes a wear member 14 that mounts onto a support structure or base of an earth working equipment. The support structure as disclosed herein (i.e., for supporting wear members 14) can be a digging edge 12 for a bucket or other equipment. For ease of discussion, the mounting of an adapter 14 to a lip 12 of a bucket is disclosed herein. Nevertheless, the wear members could be shrouds, wing shrouds, wear plates, and the like, and the bases could be digging edges on other equipment such as dredge cutter heads, rolling drums, blades, etc.

In one example, the lip 12 defines the digging edge of a bucket or dipper of a cable shovel and includes a leading surface 16, an inner face 18 and an outer face 20. A through-hole or keyway 24 may be provided in the lip 12 passing through inner face 18 and outer face 20 to receive a lock to secure a wear member to the digging edge. Nevertheless, the keyways could be omitted and different kinds of locks used (e.g., with a lock located behind a boss). The leading surface 16 is shown as a curved surface or semi-circular in shape but other variations are possible. While only a small portion of the lip 12 is shown in the drawings, the lip 12 may include a series of through-holes 24 for the mounting of other teeth to the bucket. Various constructions (not shown) could also be provided between through-holes 24 for mounting shrouds.

The wear assembly 10 may include a stabilization system 15, a tooth 11, and a lock 60. In the illustrated example, the stabilization system 15 includes bosses 28*a*, 28*b*, keyway support 90, front support 22, and rear member 38 though other configurations including more or less components are possible. The wear assembly 10 mounts on the lip 12. The illustrated tooth 11 includes a point 45, a wear cap 13, and an adapter 14, though other configurations are possible. The illustrated lock 60 includes a threaded wedge 62 and a spool 64 such as disclosed in U.S. Pat. No. 7,171,771 (incorporated herein by reference), but other locking configurations are possible.

The stabilization system 15 increases the strength and/or stability of the wear member on the lip, leading to longer service life of the wear member and/or the lip, and/or a reduced maintenance requirement on the lip.

Figure 4A:
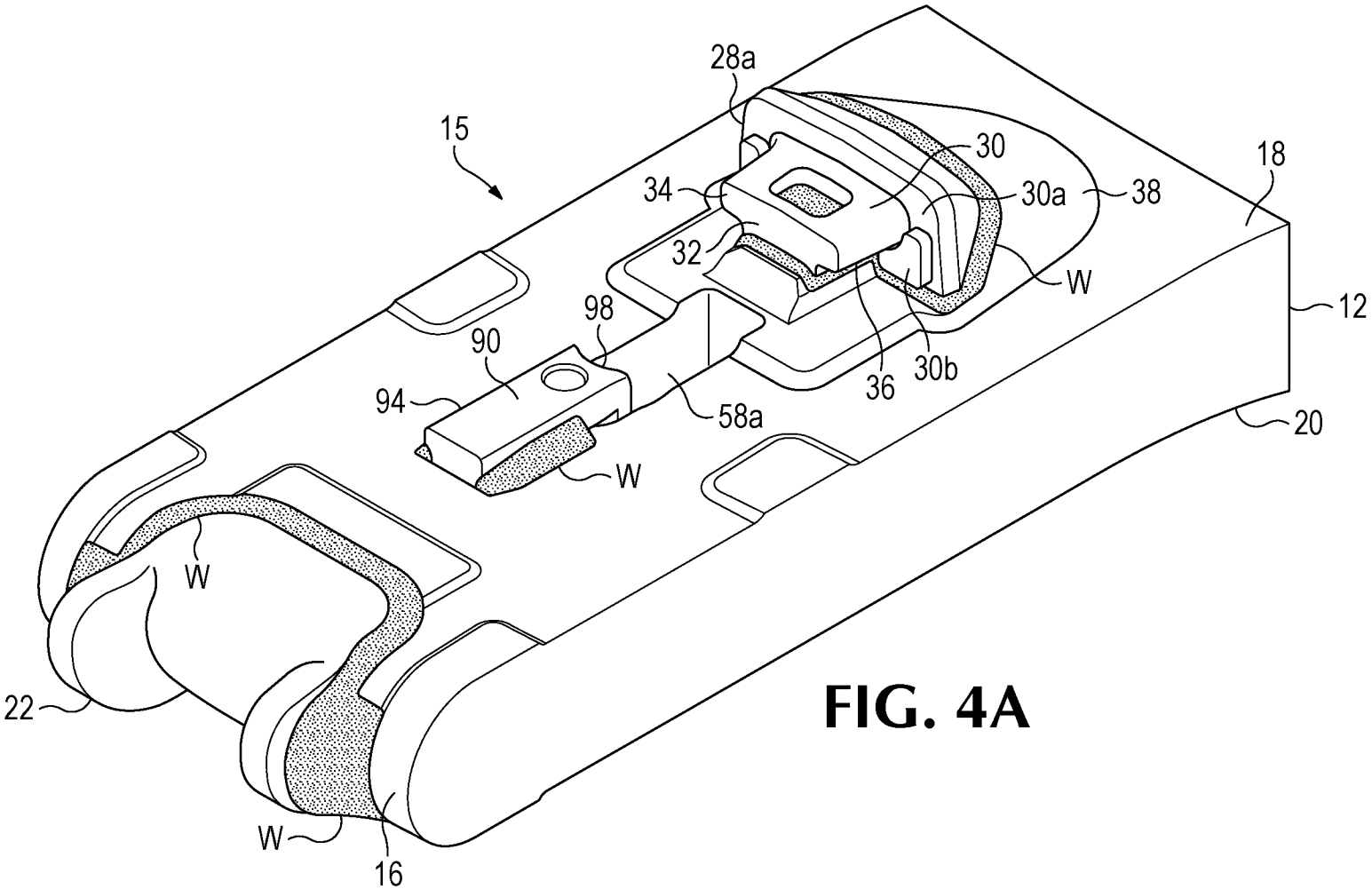
FIG. 4A is a top perspective view of an example weld pattern on a portion of a stabilization system and lip of FIG. 1.
Figure 4B:
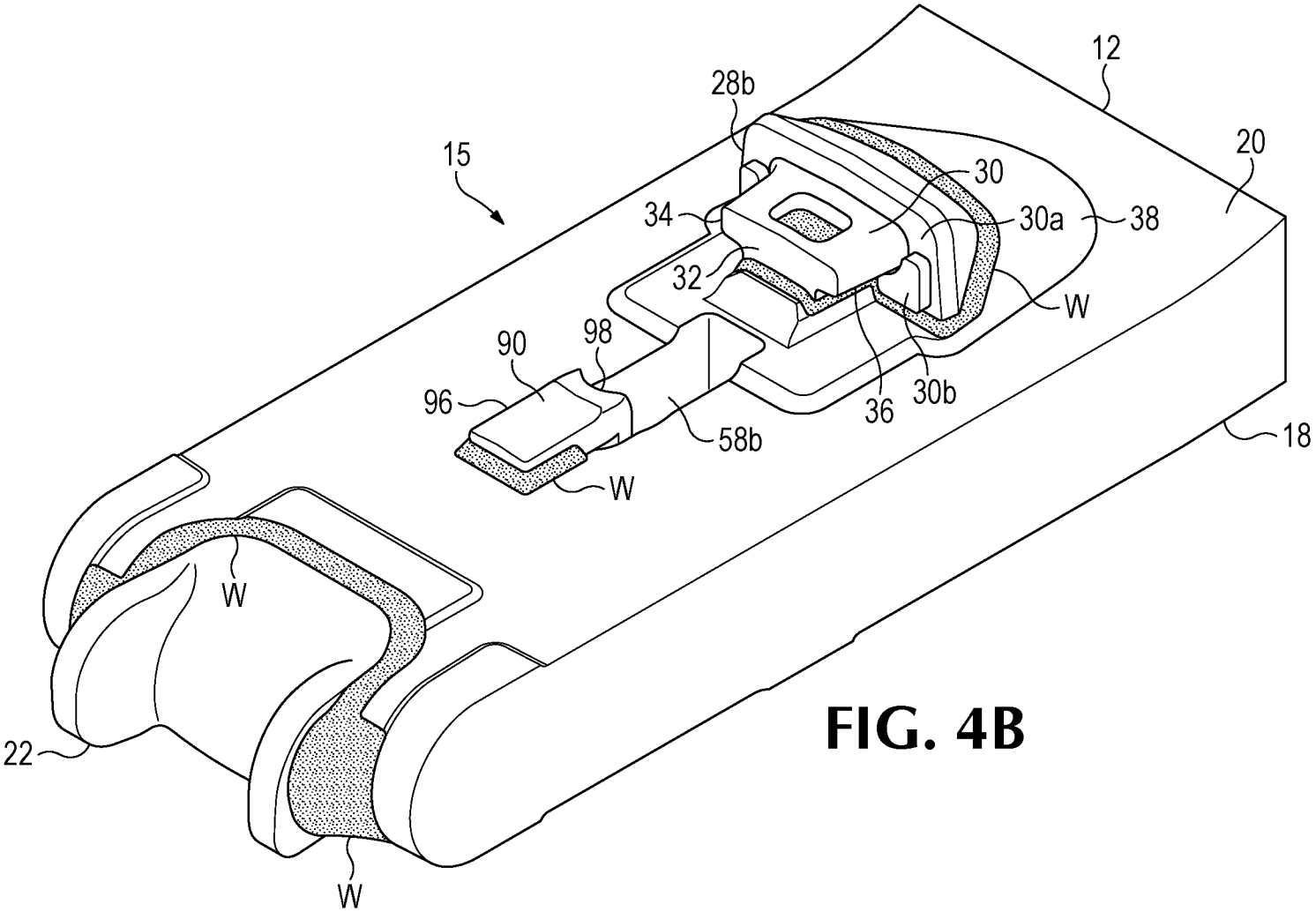
FIG. 4B is a bottom view of an example weld pattern on a portion of a stabilization system and lip of FIG. 1.

In the illustrated example of FIGS. 4A-4B, the front support 22, the keyway support 90, and the bosses 28*a*, 28*b* may be secured to the bucket lip 12 via welding W. The bosses 28*a*, 28*b* are preferably fixed to the lip rearward of and in alignment with each through-hole 24 to be received within the adapter. However, bosses could be provided to each side of through-hole 24 to provide support along external surfaces of the adapter in addition to or in lieu of internal bosses 28*a*, 28*b*. Preferably, an inner boss 28*a* is secured to extend along inner face 18 of lip 12 and an outer boss 28*b* is secured to extend along outer face 20 for each through-hole. Nevertheless, a single boss on the inner face 18 (or outer face 20) could be used, or alternatively, the bosses could be omitted. Although the bosses 28*a*, 28*b* are preferably welded to the lip, they could be formed as an integral portion of the lip or secured in other ways. The bosses 28*a*, 28*b* are preferably cast in a harder alloy than the lip 12 to aid in reducing the rate of wear in and maintenance of the lip 12, but various alloys with the same or lesser hardness could be used.

Each boss 28*a*, 28*b* preferably includes at least a main body 30 and an abutment 30*a*. In the illustrated embodiment, main body 30 has a T-shaped configuration with a base 32 and laterally extending flanges or rails 34. The abutments 30*a* abut the rear ends of the adapter legs during digging. The abutments may include inserts 30*b* such as disclosed in U.S. Pat. No. 7,171,771. The undersides of the rails 34 define holding surfaces 36 that generally face the lip to hold the adapter to the lip and resist vertical spreading of the legs of the adapter 14. The rails are preferably fixed to the abutment 30*a* for support. The rails 34 could have a dovetail or other shape to support the adapter legs. Alternatively, the rails could be omitted. While the bosses preferably have a one-piece construction, they could be defined by multiple parts.

The inner and outer faces 18, 20 of the lip 12 can also each include a rear member 38 located at the rear end of the bosses 28*a*, 28*b*. In the illustrated embodiment, the bosses are welded with weld W (or otherwise secured) to rear members 38 to aid the bosses 28*a*, 28*b* in resisting the applied loads and rearward shifting of the legs, and so reduce the risk of adapter breakage. In the illustrated example, the rear member 38 is separate from the bosses 28*a*, 28*b*, but in other examples the bosses and rear member may be formed as a single piece or the rear member and/or the bosses could be formed as an integral part of the cast lip.

Keyway support 90 may be provided as a keyway insert, which may have a generally C-shaped configuration with a central body 92, an inner flange 94 and/or an outer flange 96 (although other shapes are possible). Inner and outer flanges 94, 96 overlie and are welded to the inner and outer faces 18, 20, respectively, of lip 12. The rear surface 98 of central body 92 is preferably arcuate to receive the front side of wedge 62 but could have other shapes particularly if a different kind of wedge or lock were used. Keyway support or insert 90 functions to provide a longer and more deformation resistant bearing surface against which wedge 62 can bear. The flanges 94, 96 may be the same or varied in length to one another and may include plug welds. The flanges 94, 96 may be one piece or broken up into several components (e.g., the outer flange 96 could be composed of two components). The flanges 94, 96 preferably provide additional side support for the adapter but could be used to just support keyway support 90. The flanges 94, 96 could be longer and extend farther from through-hole 24 even up to front support 22 or leading surface 16. With the use of longer arms (or for other reasons), one or both flanges 94, 96 could be separate components welded to the lip apart from the central body 92. While an insert welded to the lip is illustrated, the keyway supports could be secured by other means (e.g., bolts) or be integrally formed as parts of a cast lip. Alternatively, the flanges could be provided to each side of the keyway to provide support against external surfaces of the adapter. One or both flanges could be omitted, and the keyway support 90 could be omitted.

Figure 5A:
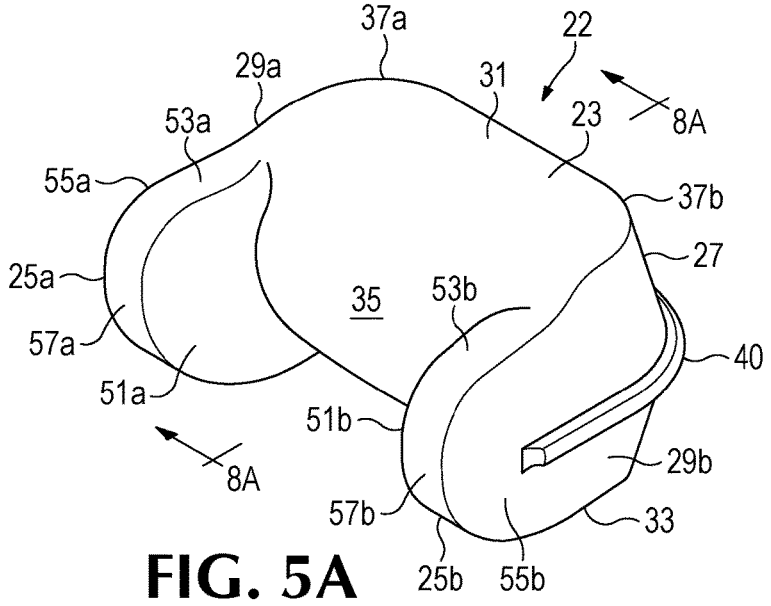
FIG. 5A is a front perspective view of an example of an insert to be attached to the lip.
Figure 5B:
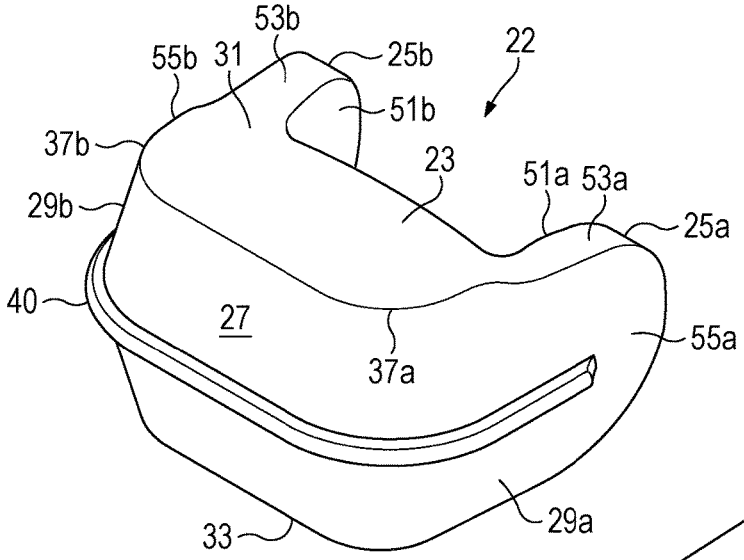
FIG. 5B is a back perspective view of the insert of FIG. 5.

Referring to FIGS. 5A-5B, an exemplary front support 22 for the leading surface 16 of the digging edge is shown. In the illustrated example, the front support 22 is provided as a front insert 22*a*, which may have a generally C-shape configuration with a central body 23 and arms 25*a*, 25*b* with ends 57*a*, 57*b*. The central body 23 and arms 25*a*, 25*b* provide front bearing surface 35 and lateral bearing surfaces 51*a*, 51*b* against which the adapter can bear. Nevertheless, insert 22*a* is optional. Front support 22 may be provided by forming the leading surface 16 of the lip 12 (or other base) to provide front bearing surface 35 and lateral bearing surfaces 51*a*, 51*b*.

The insert 22*a* is substantially complementarily shaped relative to a depression or cutout 49 on the leading surface 16 of the lip 12, though preferably slightly smaller to allow for weld material W (FIG. 4A-4B). The main body 23 includes a rear surface 27, side surfaces 29*a*, 29*b*, inner or top surface 31, outer or bottom surface 33, and a front bearing surface 35.

The rear surface 27 may include rounded corners 37*a*, 37*b*, though other configurations are possible. For example, the rear surface 27 may converge from the inner surface 31 and the outer surface 33 to a center of the rear surface 27. At the center, in the illustrated example is a weld shelf 40, though other configurations are possible. The weld shelf 40 wraps around the rear surface 27, rounded corners 37*a*, 37*b*, and along the side surfaces 29*a*, 29*b* of the main body 23. A length of the weld shelf in the illustrated example stops to align with the leading surface 16 of the lip and does not extend onto the arms 25*a*, 25*b*, but other configurations are possible. The weld shelf 40 engages an inner surface 42 of a cutout 49 of the lip 12 (FIG. 4A-4B). The cutout 49 being substantially rounded rectangular in shape, though other configurations are possible.

During installation, the insert 22*c* is inserted into the cutout 49 of the lip until the weld shelf 40 engages the inner surface 42. The weld material W may be applied in-between the insert 22*c* and the lip 12 on both sides of the weld shelf 40 to form front support 22 (FIG. 4A-4B). Afterwards, the adapter 14 is positioned onto the support 22. The support 22 may be laterally inset as shown in FIG. 1 or flush with the adapter outer surface or extend outward of the adapter. Thereafter, the lock 60 may fit through holes 58*a*, 58*b* of the adapter and a through hole 24 of the lip 12. Regardless of the form of the insert, the projection of arms 25*a*, 25*b* could extend farther forward or rearward than as shown in the illustrations. The lateral bearing surfaces 51*a*, 51*b* (whether an insert 22*a* is used or not) can be inward or flush or extend outward of the remaining lateral extension of the leading surface 16.

Figure 6:
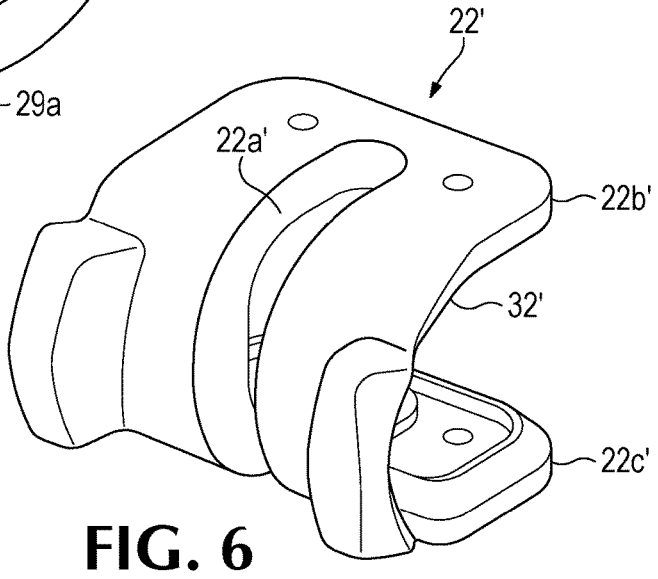
FIG. 6 is a perspective view of a second example of an insert to be attached to the lip.

During end of life of the insert 22*a*, the entire piece can be cut out and replaced as in installation. Other insert configurations are possible, such as, insert 22' having a sheath design shown in FIG. 6. The insert 22' is designed to fit about the leading surface 16 of the lip 12 rather than inside of a cutout. The insert 22' includes a curved main body 32' to wrap around the leading surface 16 instead of engaging the cutout 49. An opening 22*a*' in main body 32' is shown in FIG. 6 to accommodate a projection on the leading surface 16 of the lip. The projection could but need not be engaged by the adapter for additional side stabilization. The opening 22*a*' could be omitted if the projection is absent or removed. Moreover, while insert 22' is shown as having legs 22*b*', 22*c*' that extend over the inner and outer sides of lip 12, the insert could exclude one or both legs. With both legs omitted, insert 22' could be welded to the leading edge of the lip.

Any of the inserts could also be formed as separate arm and/or front bearing surface attachments rather than as a single component. While an insert 22 or 22' is preferred, the lip 12 could be formed directly with lateral bearing surfaces 51*a*, 51*b* and front bearing surface 35 (i.e., without the use of an insert or attachments).

In the illustrated embodiment shown in FIGS. 1-5B, the front bearing surface 35 is situated in-between the lateral bearing surfaces 51*a*, 51*b*. The front bearing surface 35 is convex in a side-to-side direction, i.e., in a direction extending from lateral bearing surface 51*a* to lateral bearing surface 51*b* (e.g., along a horizontal plane). Front bearing surface 35 is also convex in a vertical direction extending from inner face 20 to outer face 18.

In one example, the side-to-side curvature of front bearing surface 35 conforms to a section angle with a radius R1 that is created from a center or origin located within through hole 24 receiving lock 60. Alternatively, the origin of the radius could be rearward or forward of the through hole 24. In this example, the lateral (i.e., side-to-side) shape of the front bearing surface 35 forms a portion of a circle centered at the center of the wedge 62 (or other part of the through-hole), but other configurations are possible. In the illustrated example, the lateral convex shape of the front bearing surface 35 contrasts with the linear surface lateral extension of the non-support portions of the leading surface 16.

The front bearing surface 35 bears against a complementary rear bearing surface on the adapter 14. The use of a support 22 with a side-to-side convex front bearing surface 35 helps protect the lip from gouging or other wear caused by the adapter 14 and, thus, reduces lip maintenance and the consequent machine downtime. The convex side-to-side shape approximates the natural side to side motion commonly experienced by the adapter 14 during use to reduce wear and stress concentrations. While a circular portion is shown, the convex front bearing shape could conform to a curve that is not defined by a uniform radius of curvature. For example, the lateral convex curvature could be defined by a broader or sharper curvature or a changing curvature. The lateral convex shape could also be formed by linear segments or a combination of linear and curved segments. Front bearing surface 35 could also have other side-to-side shapes including, for example, linear, concave, V-shaped, parabola, curved corners, logarithmic, golden ratio spiral, exponential, other non-single radii configurations, etc.

Lateral bearing surfaces 51*a*, 51*b* project forward of the front bearing surface 35 and optionally forward of the leading surface 16 outside of support 22 to aid in installing, stabilizing and supporting the adapter 14. Nevertheless, the lateral bearing surfaces 51*a*, 51*b* could be situated forward or rearward of the location shown in FIGS. 1-4B. For example, the lateral bearing surfaces 51*a*, 51*b* could be even with the remaining leading surface 16, recessed relative to the remaining leading surface 16 or extending forward of remaining leading surface 16. The lateral bearing surfaces 51*a*, 51*b* are situated on either side of the adapter 14 to resist side to side motion of the adapter and maintain a more stable fit.

In the illustrated example, the length L2 of the arms 25*a*, 25*b* is shown to be about a $\frac{1}{3}^{rd}$ of the overall length L1 of the insert 22*a* (FIG. 7), but other configurations are possible. The length of each lateral bearing surface 51*a*, 51*b* (i.e., from front surface 35 to their forward end) may be substantially similar to the length of side bearing surfaces 65*a*, 65*b* on the adapter 14 that bear against the lateral bearing surfaces 51*a*, 51*b*. When an insert 22*a* is used, the arms 25*a*, 25*b* are flanges with inner or top surfaces 53*a*, 53*b*, exterior surfaces 55*a*, 55*b*, and interior bearing surfaces 51*a*, 51*b* that are inclined to converge rearward. The same support configuration can be provided when not using an insert. The top and bottom surfaces 53*a*, 53*b* are spaced from the adapter 14 when installed and are preferably non-bearing against the adapter.

Figure 7:
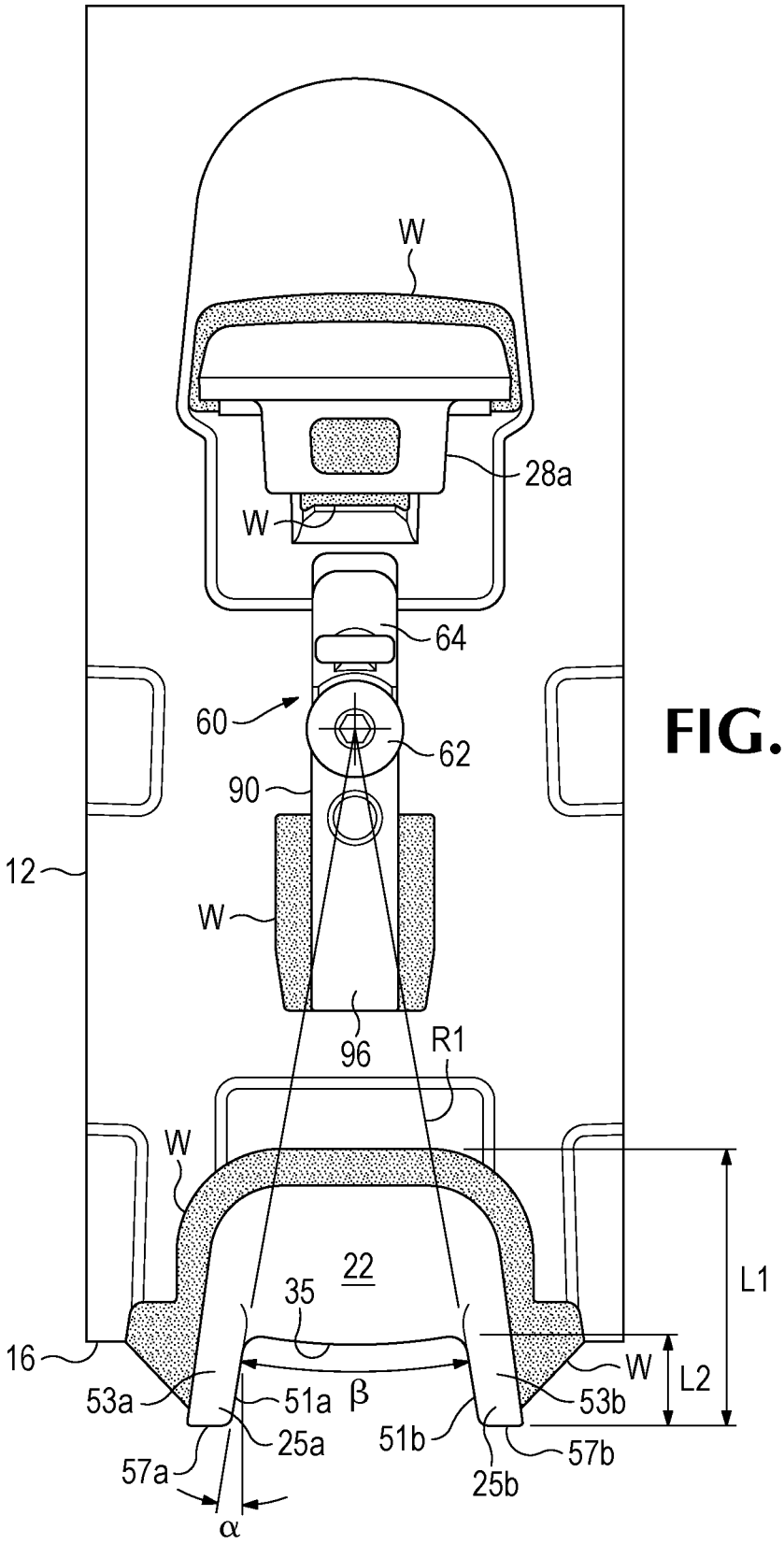
FIG. 7 is a top view of the insert attached to the lip.

The lateral bearing surfaces 51*a*, 51*b* are preferably planar but could have other shapes (e.g., curved, convex, concave, etc.). An angle $\alpha$ of the interior bearing surfaces 51*a*, 51*b* is between 0 to 60 degrees to the longitudinal axis C, and preferably between 5 and 30 degrees (i.e., with a preferred included angle $\beta$ between the lateral bearing surfaces 51*a*, 51*b* of 10-60 degrees). While the extensions of the inclined lateral bearing surfaces 51*a*, 51*b* are shown in FIG. 7 as being aligned with radius R1, they need not be. While the origin of the radius of curvature for front surface 35 and the intersection of the extensions of the inclined lateral surfaces 51*a*, 51*b* are both shown in FIG. 7 in the through hole 24, either or both could be moved forward or rearward of the illustrated location and either or both could be located in or out of the through hole 24. The lateral bearing surfaces 51*a*, 51*b* engage the adapter 14 to provide side stabilization, and resist rearward and the side-to-side motion of the adapter 14 to increase the stability of the mounted adapter, reduce stress in the components, and prolong wear life for the adapter 14 and lip 12. The inclined lateral bearing surfaces 51*a*, 51*b* are oriented to take rearward thrust loading, sideloads, or a combination.

The front bearing surface 35 can optionally have a non-uniform configuration when extending in a vertical direction from inner face 20 to outer face 18. This non-uniform configuration can be considered as being split into an upper profile 60 and a lower profile 61. The front surfaces 57*a*, 57*b* of the arms and the front bearing surface 35 may optionally share the same or substantially similar vertical curvature, but other configurations are possible. Since the front surface of the arms are preferably non-bearing, they can have virtually any shape. Further, the vertical profile of the front bearing surface could be a flat surface or defined by a constant radius.

The curvature about both or either the vertical and horizontal planes of the front surface of the leading edge support 22 offers an increased stability and resistance to rearward and lateral loads applied to the teeth during use, especially to the lower legs of the wear member. The rear abutments further stabilize the teeth and reduce stress on the front of the lip by resisting axial loads.

Although the points wear out most frequently, the adapters are also subjected to wear and require periodic replacement. The adapters receive bottom wear that may cause premature loss due, e.g., to failure of the lower legs of adapters. Altering the transverse profiles 60, 61 of the front bearing surface 35 and the complementary rear bearing surface 63 can reduce the risk of premature breakage.

Figure 8A:
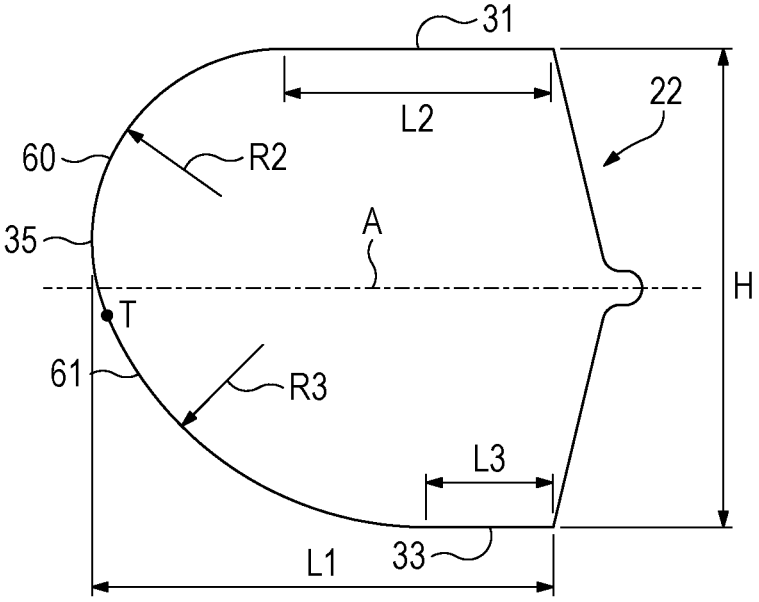
FIG. 8A is a cross-sectional view of the insert of FIG. 5A.
Figure 9:
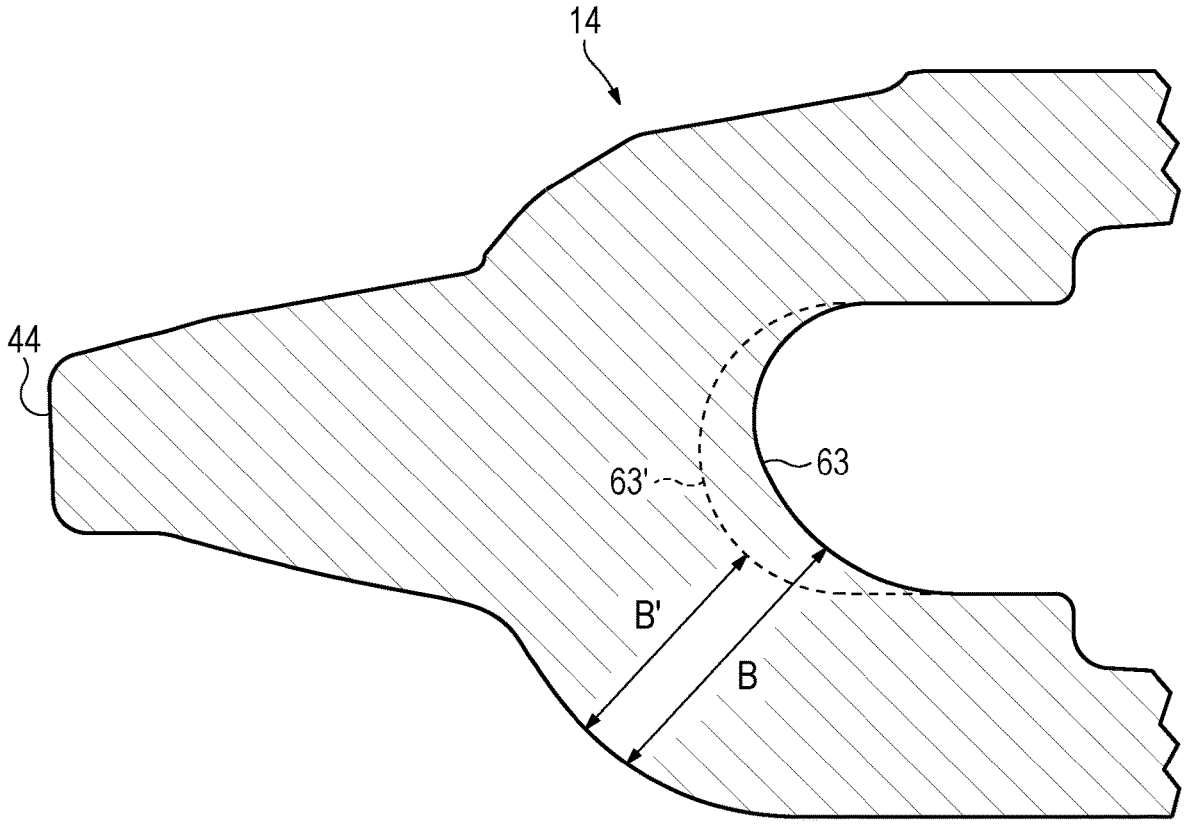
FIG. 9 is a cross-sectional view of an exemplary wear member in accordance with the present disclosure.

In one example, in FIG. 8A, a front surface 35 defined by multiple curvatures, e.g., a dual radius R2, R3, is shown such that the upper profile 60 of the front bearing surface 35 has a smaller radius R2 than the radius R3 of the lower profile 61. The radii R2, R3, in this example meet at a tangential T below a central line A, though a flat or other curved surface could connect the two curves defined by radii R2, R3. The central line A bisects the height H of the support 22, which in this example is from inner surface 31 to outer surface 33 adjacent front surface 35. The larger radius R3 over radius R2 gives the front bearing surface a longer arc length for lower profile 61. This allows the adapter 14 to be inset into the lip 12 more than a conventional lip (e.g., where radii R2 and R3 are equal). This is illustrated in FIG. 9 where a line B is shown that intersects through lower leg side surface 67*a* and rear bearing surface 63 and begins at bottom surface and ends at the rear bearing surface 63. A line B' intersects through lower leg side surface 67 and conventional rear bearing surface 63'. FIG. 9 illustrates the difference in material between the lengths of B and B', where the length of B is greater than the length B'. As the bottom legs tend to wear faster due to a lack of a wear cap, this additional inset adds more material (B-B') to give the lower leg 48*a* more strength and prolong life of the adapter 14.

Although FIG. 8A shows the upper profile and the lower profile each being defined by a single radius of curvature, variations are possible. For example, the upper and lower profiles 60, 61 may each be defined by one or more radius of curvature with or without one or more flat segments in between certain curves (e.g., at the transition between the upper and lower profile). In the FIG. 8A example, the upper profile 60 is defined by a tighter curvature and the lower profile 61. In one example, the upper profile 60 is defined at least in part by one or more upper radius of curvature, the lower profile is defined at least in part by one or more lower radius of curvature, and at least one upper radius of curvature is smaller than any lower radius of curvature.

Figure 8B:
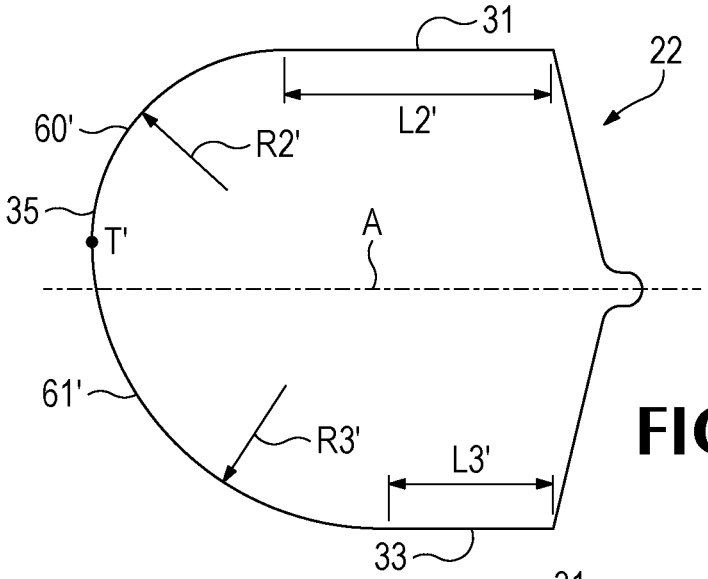
FIG. 8B is a cross-sectional view of the insert according to a second example of the present disclosure.

Referring to FIG. 8B, a similar example to FIG. 8A is illustrated with the radius R2' of the upper profile 60' being less than the radius R3' of the lower profile 61', but the radii R2', R3' meet at a tangent T' above the central line A. The radius R3' is smaller than radius R3 of FIG. 8A. The same benefits apply in FIG. 8B as FIG. 8A, but because R3 is greater than R3', this allows the adapter 14 to be inset more in FIG. 8A over FIG. 8B. As with upper and lower profiles 60, 61, the upper and lower profiles 60', 61' may each be defined by one or more radius of curvature with or without one or more flat segments in between certain curves (e.g., at the transition between the upper and lower profile). In the FIG. 8B example, the upper profile 60' is defined by a tighter curvature and the lower profile 61'. In one example, the upper profile 60' is defined at least in part by one or more upper radius of curvature, the lower profile 61' is defined at least in part by one or more lower radius of curvature, and at least one upper radius of curvature is smaller than any lower radius of curvature.

In the examples of FIGS. 8A-8B, the larger one or more radius R2 (i.e., a broader curve) of FIG. 8A as compared to the smaller one or more radius R2' (i.e., a tighter curve) of FIG. 8B allows more material for the adapter 14 to engage during loading. The larger radius absorbs more of that impact and reduces localized stress. By relieving stress applied to the leading surface 16 of the lip 12, the lip 12 will tend to last longer and require less maintenance during its useful life. Improved stability can also lengthen the useful life of the adapters and/or the buckets. The examples of FIGS. 8A-8B are more stable in top load. This is because a length L2 is longer than L3 in FIG. 8A, and L2' of the top surface 31 is greater than a length L3' of the bottom surface 33 in FIG. 8B.

Figure 8C:
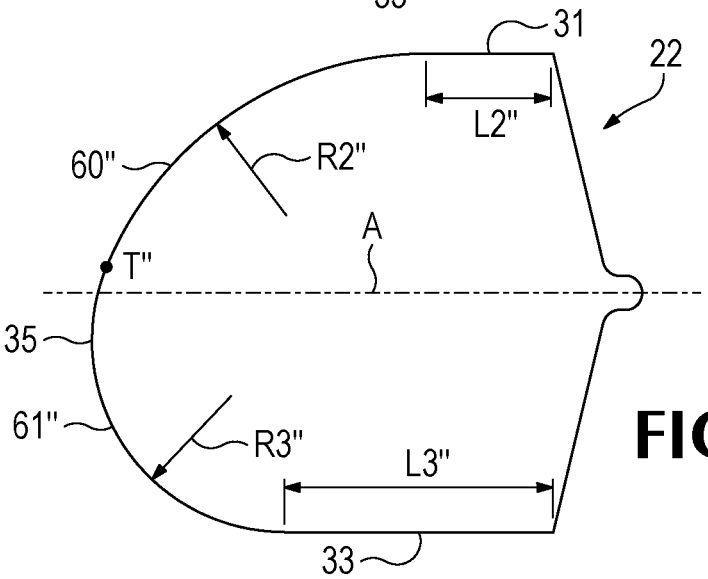
FIG. 8C is a cross-sectional of the insert according to a third example of the present disclosure.

Referring to FIG. 8C illustrates an opposite scenario, where the upper profile 60" has a larger radius R2" than the radius R3" of the lower profile 61". A tangent T" is created where the profiles 60" and 61" meet above the central line A, but it could be configured so that the tangent was above or below the central line A. In this example, the radius R2" is greater than the radius R3", so the arc length of profile 60" is longer than the arc length of profile 61". Since the profiles 60", 61" are biased downward instead of upward as in FIGS. 8A and 8B, the opposite is true, such that the upper leg is inset into the lip 12 permitting more material to strengthen the upper leg. Alternatively, the wear cap 13 could be lowered, while retaining upper leg strength, to beneficially alter material flow over the adapter. The example of FIG. 8C is more stable in bottom load. This is because a length L2" of the top surface 31 is smaller than a length L3" of the bottom surface 33. The upper and lower profiles 60", 61" may each be defined by one or more radius of curvature with or without one or more flat segments in between certain curves (e.g., at the transition between the upper and lower profile). In the FIG. 8C example, the lower profile 61" is defined by a tighter curvature and the upper profile 60". In one example, the lower profile 61" is defined at least in part by one or more lower radius of curvature, the upper profile 60" is defined at least in part by one or more upper radius of curvature, and at least one lower radius of curvature is smaller than any upper radius of curvature Referring to FIGS. 9-11, the adapter 14 is a wear member that is mounted to the lip 12 of a bucket. The adapter 14 supports the earth-penetrating points 45 and secures them to the lip. Adapter 14 includes a forwardly projecting nose 44 for mounting a point 45, and a mounting end 46 with bifurcated legs 48*a*, 48*b* to straddle the lip 12. With the use a robust boss and/or other supports, adapter may have only one leg on the inner (or outer) face of the digging edge.

In one example, the legs 48*a*, 48*b* are of equal length and are each provided with a slot 50*a*, 50*b* shaped to receive the inner and outer bosses 28*a*, 28*b* and/or flanges 94, 96, respectively. The upper leg 48*a* is situated to engage the inner face 18 of the lip 12 and the lower leg 48*b* is situated to engage the outside face 20 of the lip 12. The upper leg 48*a* includes a hole 58*a* through which a lock 60 may be inserted. The hole 58*a* may be sized and shaped to correspond to the through-hole 24 in the bucket lip 12. The hole 58*a* is positioned such that when the adapter 14 is properly placed on the bucket lip 12, hole 58*a* is aligned with through-hole 24 to allow the lock 60 to fit therethrough (FIG. 3). Similarly, the bottom leg 48*b* includes a hole 58*b* aligned with hole 58*a* of the top leg 48*a*. Thus, the lock 60 may fit through holes 58*a*, 58*b*, 24 after the adapter 14 is properly placed in the bucket lip 12.

The legs 48*a*, 48*b* are connected via a rear-facing bight portion that defines a mounting portion 68 to bear against support 22. The rear-facing mounting portion 68 may include two side bearing surfaces 65*a*, 65*b* to bear against lateral bearing surfaces 51*a*, 51*b* of support 22, and a rear bearing surface 63 to bear against front bearing surface 35 between side bearing surfaces 65*a*, 65*b*.

In one example, the rear bearing surface 63 is concave and conforms to the front bearing surface in a side-to-side direction and in a vertical direction with all the possible variations disclosed for the front bearing surface 35 (i.e., with same or similar shapes). The angle of the side bearing surfaces 65*a*, 65*b* are the same or similar to the angle interior bearing surfaces 51*a*, 51*b* of support 22, e.g., between 0 to 60 degrees, and preferably between 5 and 30 degrees.

The two side bearing surfaces 65*a*, 65*b* may extend to an exterior side surface of the adapter 14. The two side bearing surfaces 65*a*, 65*b* are illustrated to be recessed such that when fully engaged with the two interior surfaces 51*a*, 51*b* support 22. When an insert 22*a* is used, the outer surfaces 57*a*, 57*b* of the arms 25*a*, 25*b* are in this example recessed within each sidewall 67*a*, 67*b*, respectively, though other configurations are possible (e.g., flush). Optional transition or spacer surfaces may be provided to each lateral side of each of the side bearing surfaces 65*a*, 65*b*. For example, side bearing surfaces 65*a*, 65*b* may not extend to the external sides of adapter 14 and spacer surfaces (not shown) may be situated between side bearing surfaces 65*a*, 65*b* and the external sides of the adapter.

The two side bearing surfaces 65*a*, 65*b*, provide side stabilization for the adapter 14 that resists rotational movement about a longitudinal axis C and side to side movement, and aid in capturing the adapter 14 into its fully installed position. Since the side bearing surfaces 65*a*, 65*b* resist rear, side and rotational movements of the adapter, the adapter will tend to resist moving relative to support 22, which reduces the wear and lengthens the usable life of the adapter and the support, and in turn the lip. In the illustrated example, the side bearing surfaces 65*a*, 65*b* are planar or linear, but other configurations may be possible, such as non-linear, curved, convex, concave, and the like. The side bearing surfaces 65*a*, 65*b* and/or the lateral bearing surfaces 57*a*, 57*b* may be continuous in a vertical direction (as shown in the figures) or they may have gaps (not shown) which divide the surfaces into upper and lower segments.

Figure 10:
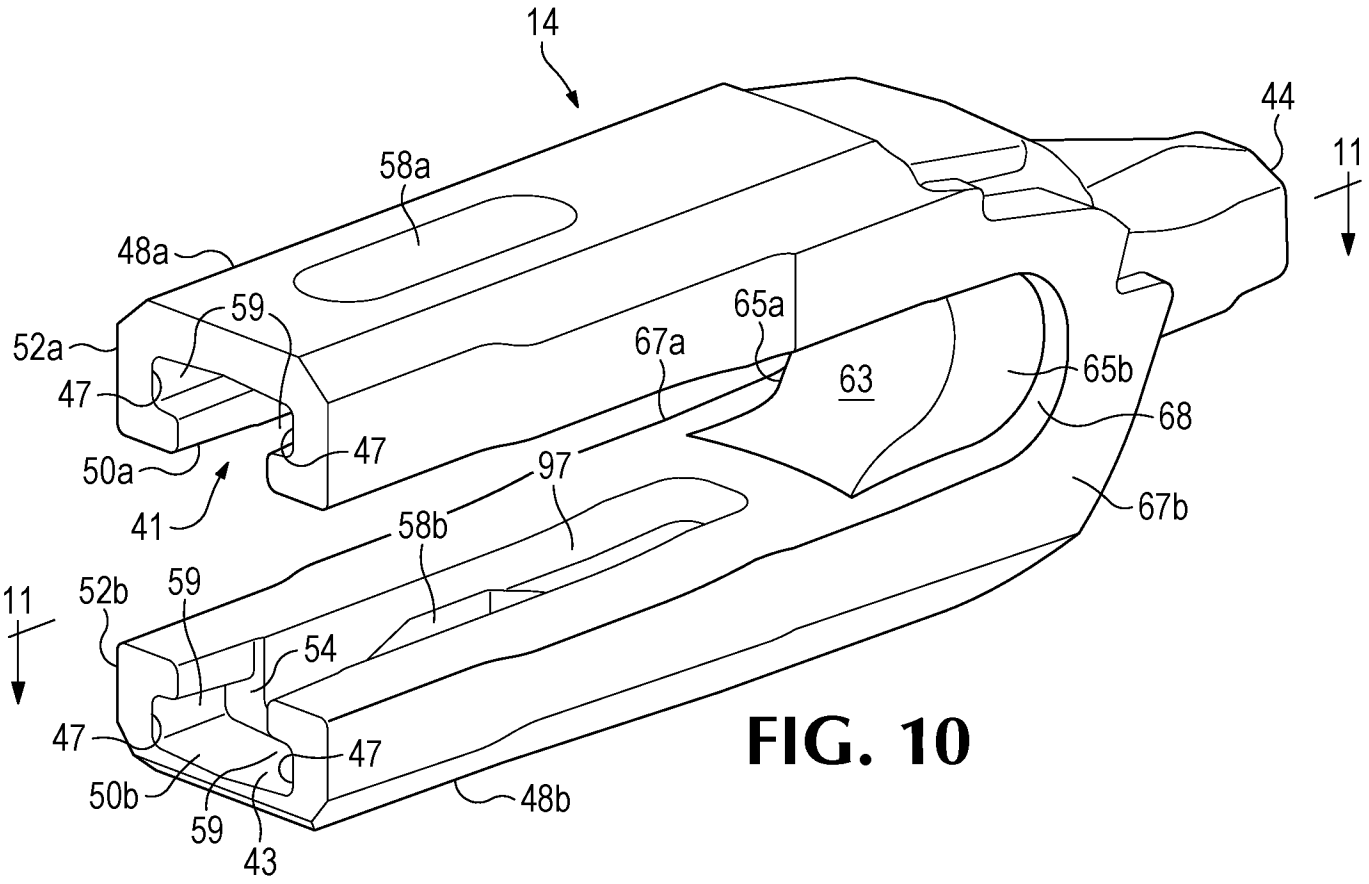
FIG. 10 is a rear perspective view of a wear member in accordance with the present disclosure.
Figure 11:
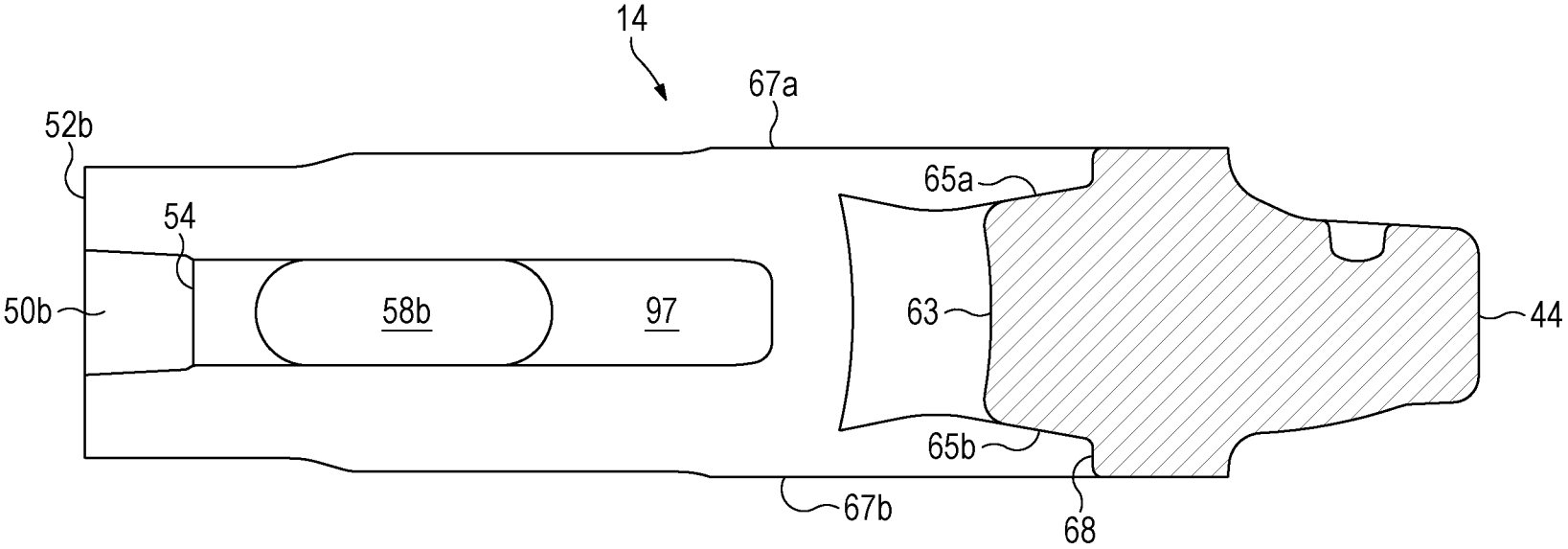
FIG. 11 is a cross-sectional view of the adapter of FIG. 10 along a line 11-11.

In the illustrated example of FIG. 10, the slots 50*a*, 50*b* are T-shaped to matingly receive bosses 28*a*, 28*b*. The shape and/or length of the slots 50*a*, 50*b* could vary so long as the slot shape still receives the boss 28*a*, 28*b* to provide the desired support to resist lateral and/or outward pressures on the legs 48. Moreover, the shape of the slots 50*a*, 50*b* can vary depending on the shape of the boss 28*a*, 28*b* and the loads to be resisted. For example, if no rails are provided on the bosses, the slots can have a generally parallepiped cross sectional shape. In another example, the slots 50*a* and/or 50*b* could be omitted if exterior bosses are used without in interior bosses 28*a*, 28*b*.

In the illustrated example, the slots 50*a*, 50*b* are open in the rear walls 52*a*, 52*b* of legs 48*a*, 48*b* to slidingly receive the bosses 28*a*, 28*b*, respectively, therein. Each slot 50*a*, 50*b* includes a recessed wall 43 spaced from and facing the respective face 18, 20 of lip 12. A narrowed portion 41 preferably sets between the recessed wall 43 and the lip 12 to define retaining surfaces 47 to receive and retain rails 34 in grooves 59 of slots 50*a*, 50*b*. Each slot 50*a*, 50*b* preferably extends forward of rear wall 52, e.g., a distance more than the length of the main body 30 of the boss 28*a*, 28*b*. In this way, the lateral wall 54 at the front of slot 50*a*, 50*b* is spaced from the front wall 56 of boss 28*a*, 28*b* (though contact is possible).

The rear walls 52*a*, 52*b* of legs 48*a*, 48*b* are preferably each spaced from abutment 30*a* and insert 30*b* with no load but abuts insert 30*b* to resist applied loads (FIG. 2), e.g., when the legs axially shift under digging loads. By abutting both the rear wall of the adapter leg against the insert 30*b*, and the front bearing surface 35 against the rear bearing surface 63, the surface area resisting the rearward thrusting loads can be maximized to lower the stress in the wear member 10 and lip 12. In one example, the curvature of rear bearing surface may not match the curvature of the front bearing surface, but still allow for bearing (e.g., a central engagement or an end engagement, etc.). The inner surface 68 of legs 48*a*, 48*b* are formed with channels 97 in which flanges 25*a*, 25*b* are received.

In assembly, the adapter 14 is rearwardly slid onto the bucket with one leg 48*a*, 48*b* to each side of the lip 12 so that bosses 28 are received into slots 50 and front bearing surface 35 and adjacent lateral bearing surfaces 51*a*, 51*b* contact rear bearing surface 63 and inclined side bearing surfaces 65*a*, 65*b* to bear against one another. In other examples, they may be spaced from one another and only engage in load. In the preferred construction, the rear wall 52 abuts against rear member 30 only after wear begins to develop due to use of the bucket.

Figure 12:
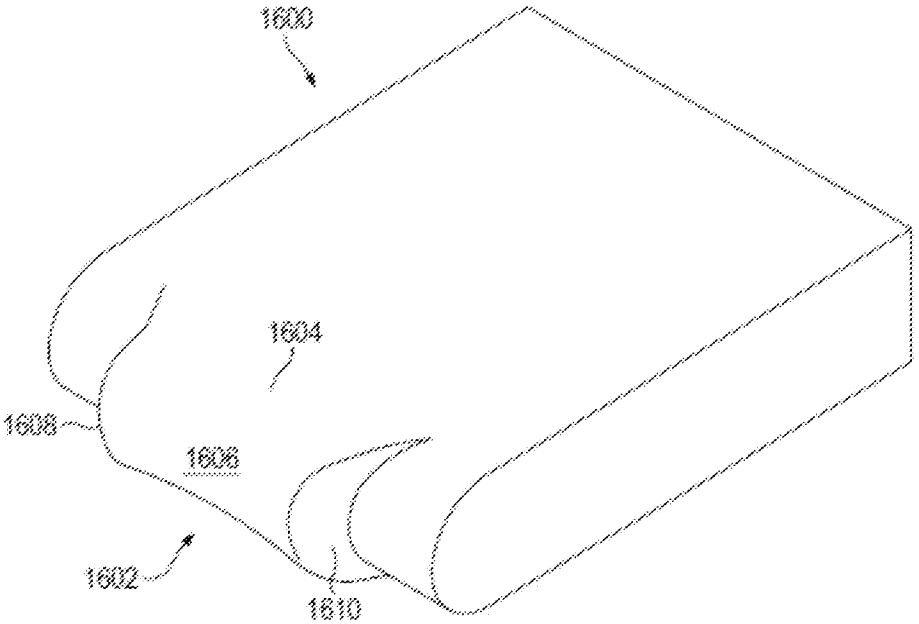
FIG. 12 is a perspective view of another digging edge.
Figure 13:
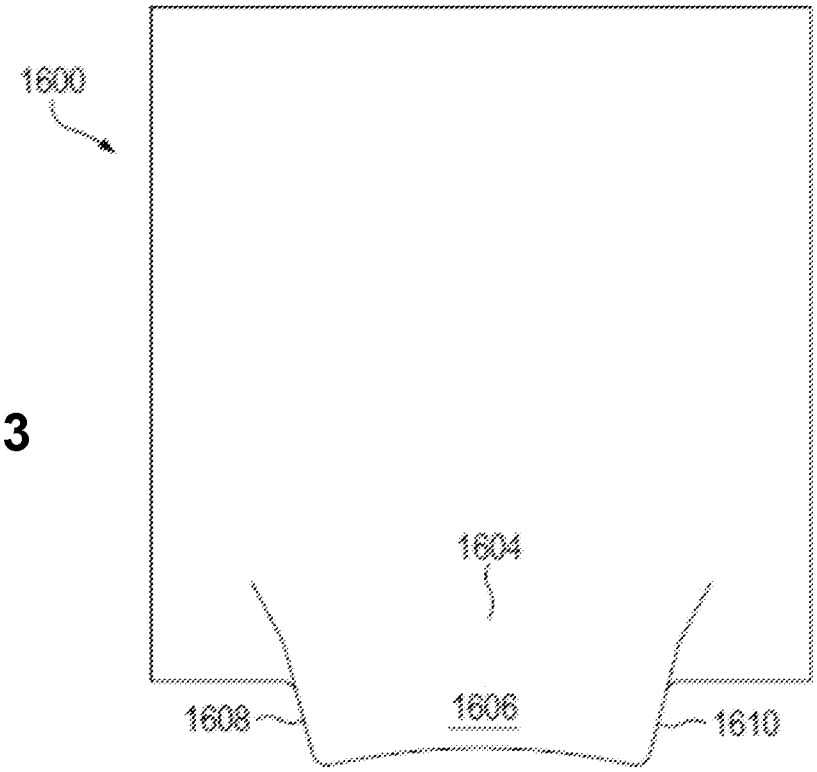
FIG. 13 is a top view of the digging edge of FIG. 12.

FIG. 12 and FIG. 13 show another example of a digging edge 1600 that can be understood as having bearing surfaces 1606, 1608 of support 1602 that are oppositely arranged as compared to those of support 22 (see e.g., FIGS. 4A and 7). Digging edge 1600 has a support 1602 including a central protrusion 1604 rather than a recess formed by front being surface 35 and lateral bearing surfaces 51*a*, 51*b*. Front support 1602 includes a front bearing surface 1606 and lateral bearing surfaces 1608, 1610. In this example, front bearing surface 1606 is concave in a side-to-side direction, but it could be laterally convex and/or have other variations such as described for front bearing surface 35. Front bearing surface 1606 could also be provided with upper and lower profiles in the same way as described for front bearing surface 35 or have a uniform vertical profile. The lateral bearing surfaces 1608, 1610 converge in a forward direction whereas lateral bearing surfaces 51*a*, 51*b* converge in a rearward direction. Lateral bearing surface 1608, 1610 could have the same variations as discussed for lateral bearing surfaces 51*a*, 51*b*. Support 1602 could be provided by an insert (not shown) or, as in FIGS. 12 and 13, as a formation along the leading surface of digging edge 1600. In this example, the rear bearing surface and side bearing surfaces of the adapter will conform to the front bearing surface 1606 and lateral bearing surfaces 1608, 1610 of digging edge 1600 to provide similar stabilization and other benefits as described for adapter 14 and support 22.

Figure 14:
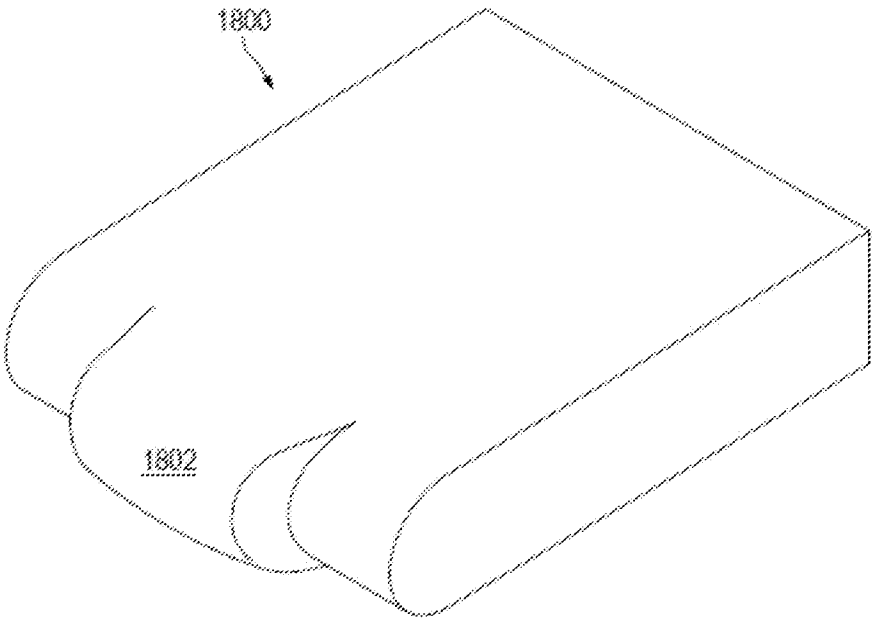
FIG. 14 is a perspective view of another digging edge.
Figure 15:
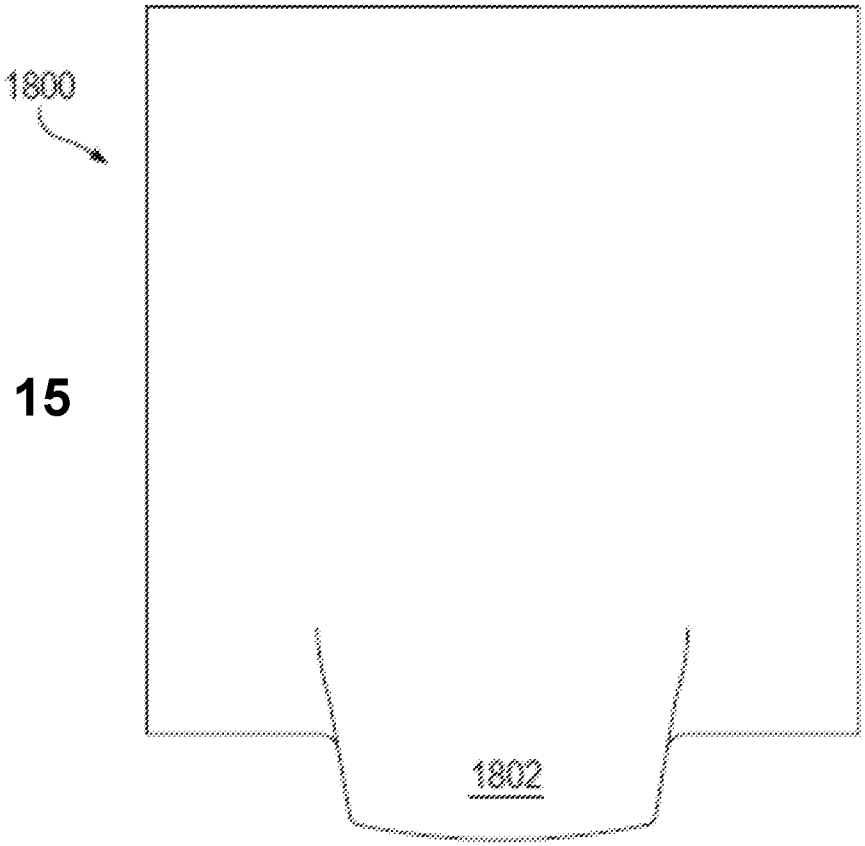
FIG. 15 is a top view of the digging edge of FIG. 14.

FIG. 14 and FIG. 15 show a variant of digging edge 1600 in the form of a digging edge 1800. Digging edge 1800 is similar to digging edge 1600, but digging edge 1800 includes a forward-facing front bearing surface 1802 that is convex in a side-to-side direction, whereas forward-facing front bearing surface 1606 is concave in a side-to-side direction. The front support configuration for digging edge 1800 could be provided by an insert (not shown) or, as in FIGS. 14 and 15, as a formation along the leading surface of the digging edge. In this example, the rear bearing surface and side bearing surfaces of the adapter will conform to the front bearing surface 1802 and lateral bearing surfaces of digging edge 1800 to provide similar stabilization and other benefits as described for adapter 14 and support 22.

Figure 16:
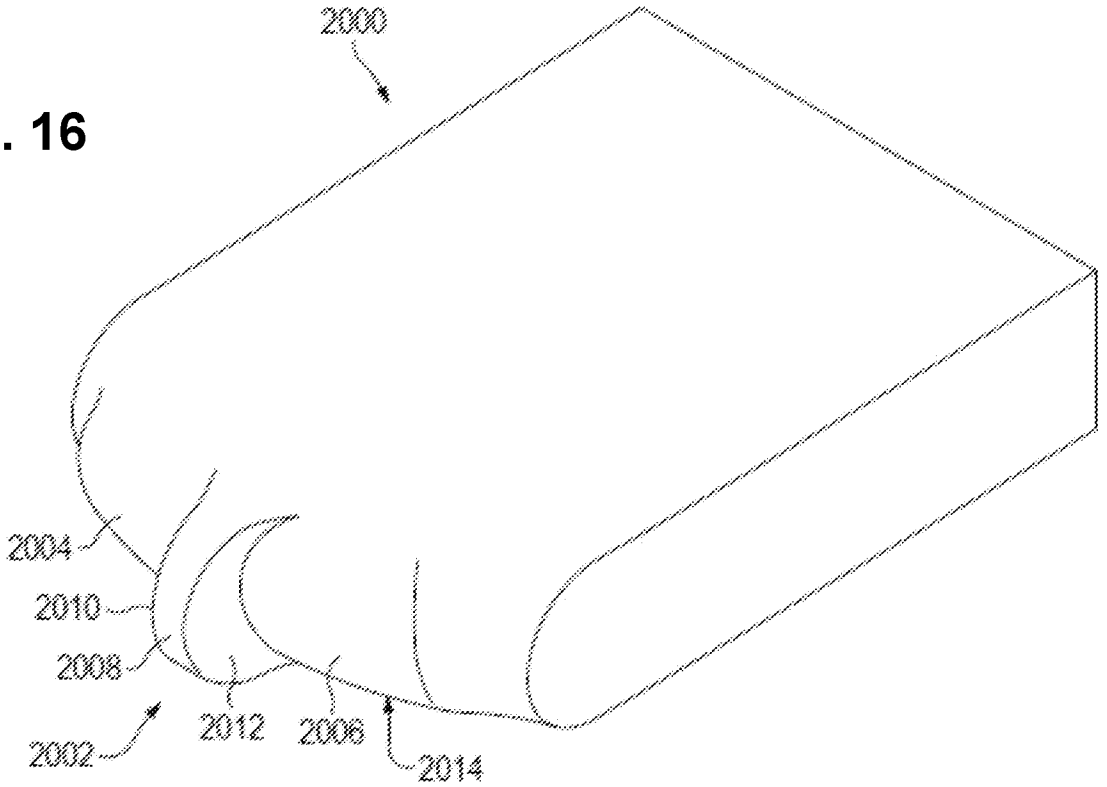
FIG. 16 is a perspective view of another digging edge.
Figure 17:
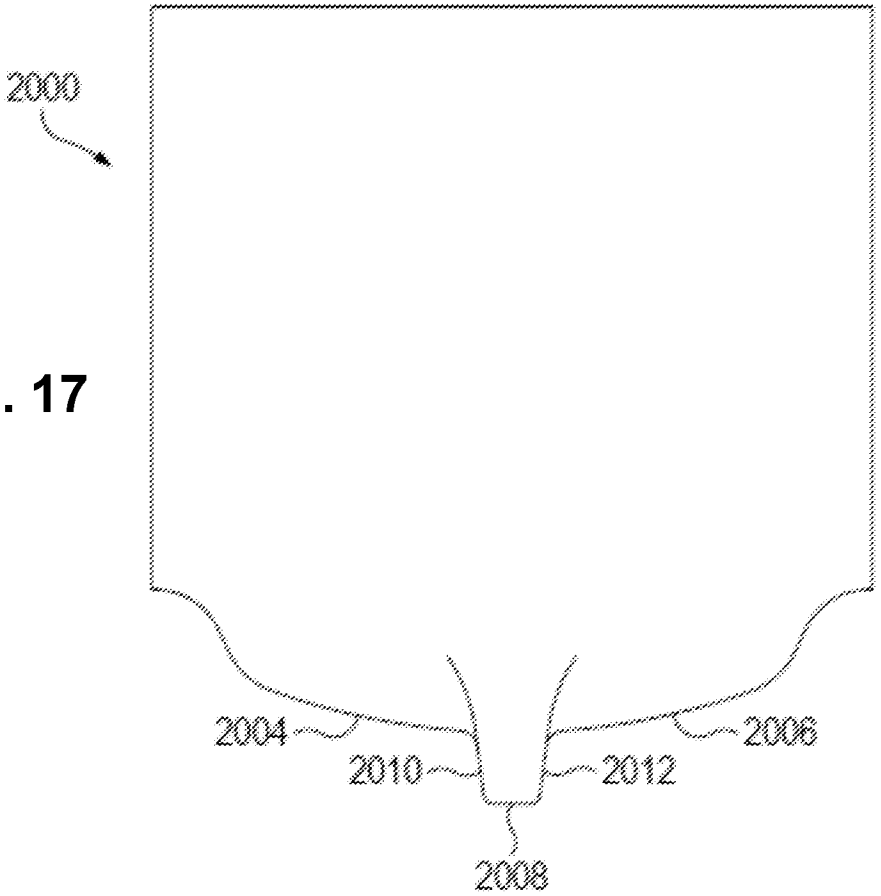
FIG. 17 is a top view of the digging edge of FIG. 16.

FIG. 16 and FIG. 17 show another example of a digging edge 2000 with a front support 2002. Digging edge 2000 includes a central projection 2008 that includes lateral bearing surfaces 2010, 2012. Front bearing surface 2014 is defined by two front bearing segments 2004, 2006, which are located to each side of projection 2008. Lateral bearing surfaces 2010, 2012 converge in a forward direction. Lateral bearing surfaces 2010, 2012 may have the same variations as described for lateral bearing surfaces 51*a*, 51*b*. Front bearing surface 2014 (i.e., including each segment 2004, 2006), in this example, is curved and convex in a side-to-side direction, but may have the same variations as described for front bearing surface 35. Front bearing surface 2004 could also be provided with upper and lower profiles in the same way as described for front bearing surface 35 or have a uniform vertical profile. Support 2002 could be provided by an insert (not shown) or, as in FIGS. 16 and 17, as a formation along the leading surface of digging edge 2000. In this example, the rear bearing surface and side bearing surfaces of the adapter will conform to the front bearing surface 2014 and lateral bearing surfaces 2010, 2012 of digging edge 2000 to provide similar stabilization and other benefits as described for adapter 14 and support 22.

Figure 18:
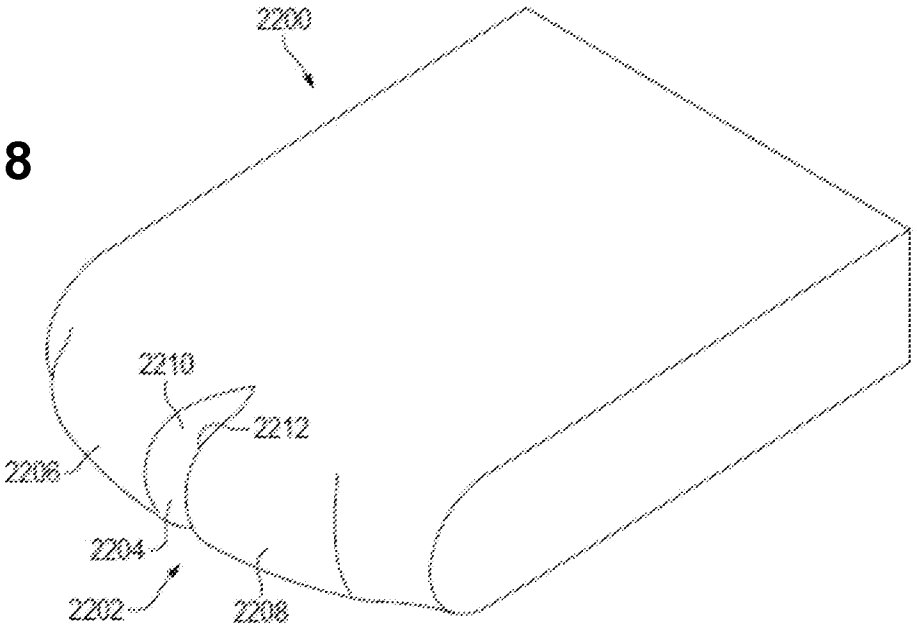
FIG. 18 is a perspective view of another digging edge.
Figure 19:
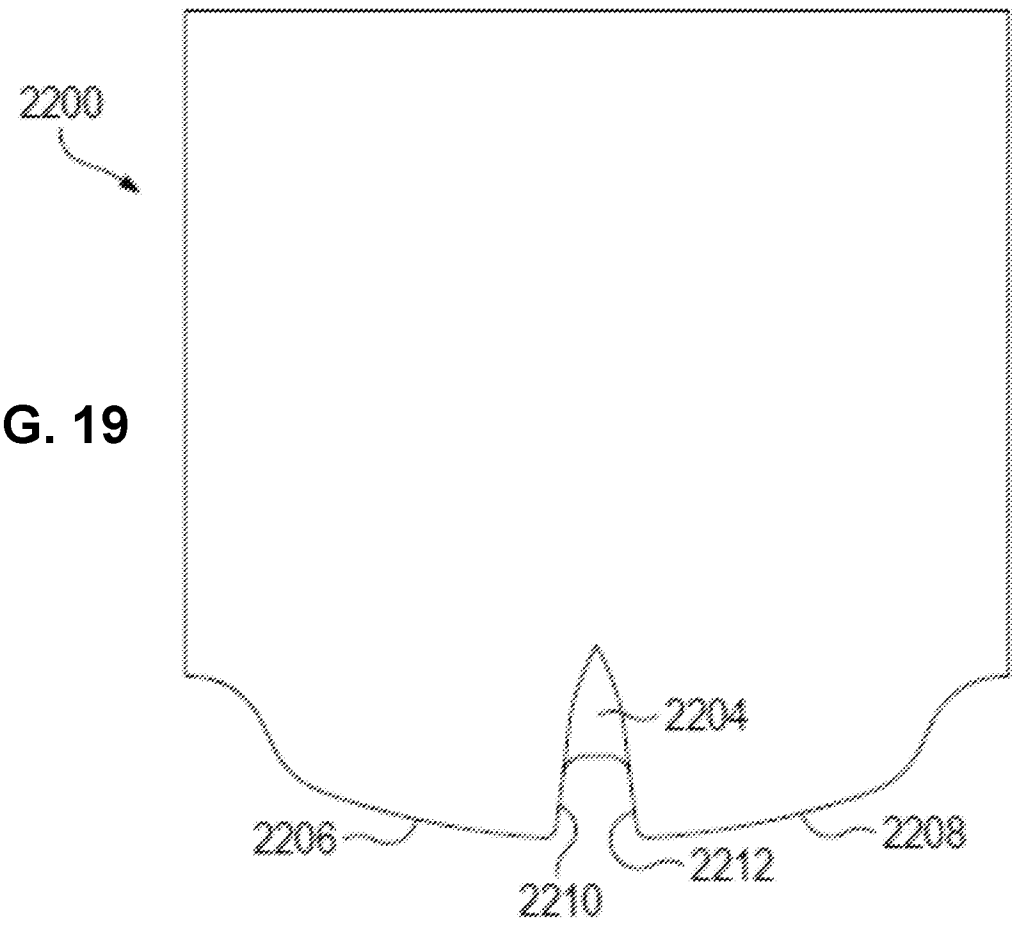
FIG. 19 is a top view of the digging edge of FIG. 18.

FIG. 18 and FIG. 19 show another example of a digging edge digging edge 2200 with a front support 2202. Digging edge 2200 includes a central recess 2204 that includes lateral bearing surfaces 2210, 2212. Front bearing surface is defined by two front bearing segments 2206, 2208 which are located to each side of recess 2204. Lateral bearing surfaces 2210, 2212 converge in a rearward direction. Lateral bearing surfaces 2010, 2012 may have the same variations as described for lateral bearing surfaces 51*a*, 51*b*. Front bearing surface 2206, 2208, in this example, is curved and convex in a side-to-side direction, but may have the same variations as described for front bearing surface 35. Front bearing surface 2206, 2208 could also be provided with upper and lower profiles in the same way as described for front bearing surface 35 or have a uniform vertical profile. Support 2202 could be provided by an insert (not shown) or, as in FIGS. 18 and 19, as a formation along the leading surface of digging edge 2200. In this example, the rear bearing surface and side bearing surfaces of the adapter will conform to the front bearing surface 2206, 2208 and lateral bearing surfaces 2210, 2212 of digging edge 2200 to provide similar stabilization and other benefits as described for adapter 14 and support 22.

Figure 20:
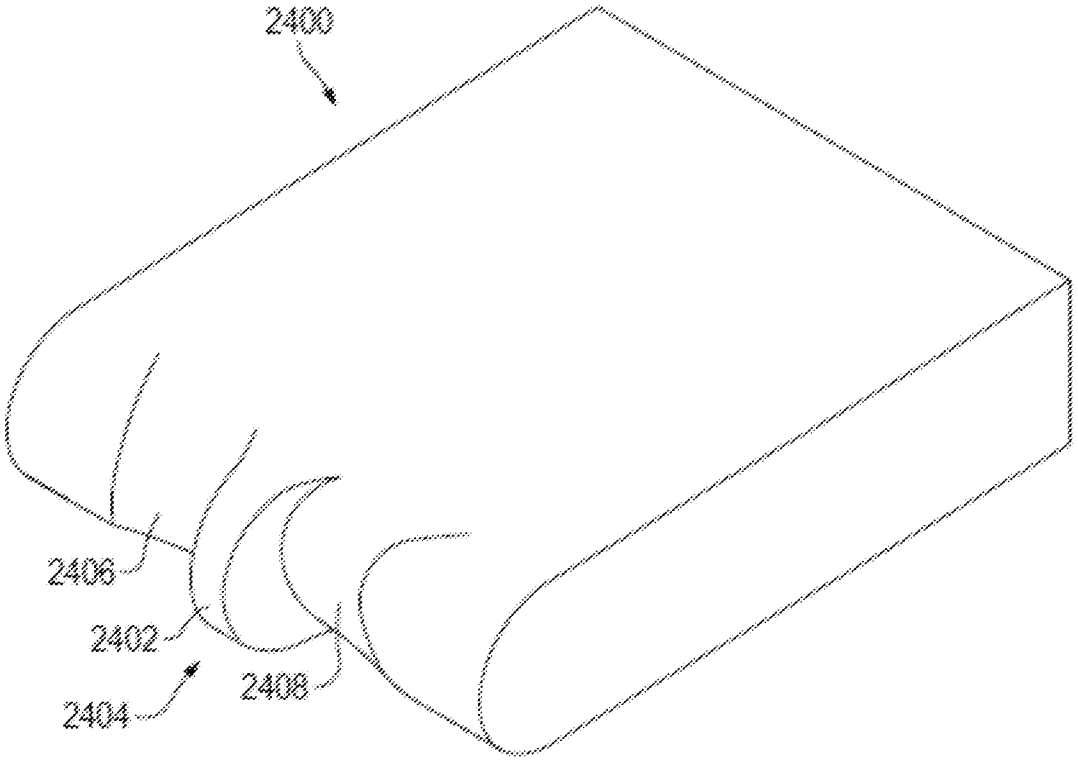
FIG. 20 is a perspective view of another digging edge.
Figure 21:
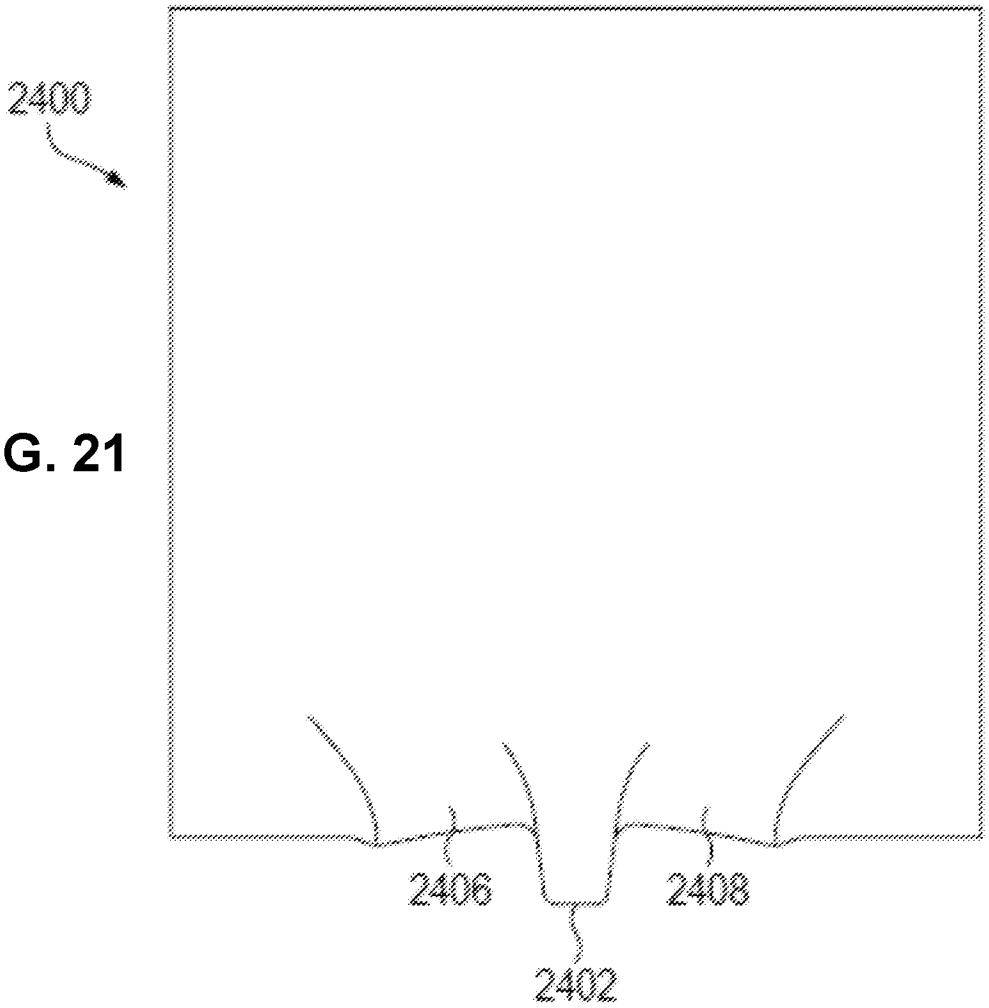
FIG. 21 is a top view of the digging edge of FIG. 20.

FIG. 20 and FIG. 21 show a variant of digging edge 2200 in the form of a digging edge 2400 with support 2404. Digging edge 2400 is similar to digging edge 2200, but digging edge 2400 includes a forward-facing front bearing surface 2406, 2408 that is concave in a side-to-side direction, whereas forward-facing front bearing surface 2206, 2208 is convex in a side-to-side direction. The front support 2404 for digging edge 2400 could be provided by an insert (not shown) or, as in FIGS. 20 and 21, as a formation along the leading surface of the digging edge. In this example, the rear bearing surface and side bearing surfaces of the adapter will conform to the front bearing surface 2406, 2408 and lateral bearing surfaces of projection 2402 to provide similar stabilization and other benefits as described for adapter 14 and support 22.

Once the adapter is properly positioned, lock 60 is inserted into openings 58*a*, 58*b* and through-hole 24. Specifically, spool 64 is placed in openings 58*a*, 58*b*, and through-hole 24. Wedge 62 is, then, threaded into the spool 64 by engaging groove 66 with ridge segments 72 and turning the wedge about its axis (FIG. 3). The threading continues until the wedge 62 tightens to a set level of torque. While the wedge 62 can abut directly against the front end 88 of through-hole 24 (FIG. 2), a keyway support 90 is preferably welded into place at the front of through-hole 24. Nevertheless, other lock arrangements may be used. To remove the adapter 14, the wedge 62 is turned to drive the wedge 62 upward so that it can be lifted out of the assembly. The spool 64 is removed from the assembly. Adapter 14 can then be pulled from the lip 12.

The systems, devices, and methods disclosed herein are examples of applications of the principles of this disclosure in practice, and a wide variety of other examples are possible. Therefore, the scope of this disclosure is not limited to the details of the wear assembly 10 and method described herein and/or depicted in the drawings. Various other examples as well as many changes may be made without departing from the spirit and broader aspects of the disclosure as defined in the claims. Aspects of the disclosure have been described in terms of illustrative examples thereof. Numerous other examples, modifications, and variations within the scope and spirit of the appended claims will occur to persons of ordinary skill in the art from a review of this disclosure. The features in one example can be used with features of another example. The examples given and the combination of features disclosed are not intended to be limiting in the sense that they must be used together.

We claim:

1. A wear member for earth working equipment comprising at least one leg and a mounting configuration which together define a cavity to receive a base of the earth working equipment, the at least one leg extends rearwardly over the base, and the mounting configuration is proximate a front of the cavity, wherein the mounting configuration includes a pair of laterally-spaced side bearing surfaces and a rear bearing surface extending between the side bearing surfaces, the side bearing surfaces and the rear bearing surface each bear against a complementary support of the base on which the wear member is mounted, the side bearing surfaces extend farther forward than the rear bearing surface, and the rear bearing surface is concave in a side-to-side direction between the side bearing surfaces.

2. The wear member of claim 1 including a pair a spaced apart legs to define the cavity to receive the base.

3. The wear member of claim 1, wherein the side bearing surfaces converge in a rearward direction to face both outward and rearward.

4. The wear member of claim 1, wherein the at least one leg includes a hole for receiving a lock to secure the wear member to the base, and at least part of the rear bearing surface in a side-to-side direction conforms to a radius of curvature that originates at a location aligned with the hole.

5. The wear member of claim 1, wherein the at least one leg includes a hole for receiving a lock to secure the wear member to the base, and the side bearing surfaces converge at an angle where extensions of the two side bearing surfaces intersect each other at a location aligned with the hole.

6. The wear member of claim 1, wherein the rear bearing surface is curved in a direction away from the at least one leg to define a curved upper profile and a curved lower profile, and wherein the upper profile has a tighter curve than the lower profile.

7. The wear member of claim 1, wherein the rear bearing surface is curved in a direction away from the at least one leg to define a curved upper profile and a curved lower profile, and wherein the lower profile has a tighter curve than the upper profile.

8. The wear member of claim 1, wherein the rear bearing surface is curved in a direction away from the at least one leg to define a curved upper profile and a curved lower profile, the upper profile is defined at least in part by one or more upper radius of curvature, the lower profile is defined at least in part by one or more lower radius of curvature, and at least one said upper radius of curvature is smaller than any said lower radius of curvature.

9. The wear member of claim 1, wherein the rear bearing surface is curved in a direction away from the at least one leg to define a curved upper profile and a curved lower profile, the upper profile is defined at least in part by one or more upper radius of curvature, the lower profile is defined at least in part by one or more lower radius of curvature, and at least one upper radius of curvature is larger than any said lower radius of curvature.

10. The wear member of claim 3, wherein the side bearing surfaces are oriented at an angle to each other of 120 degrees or less.

11. The wear member of claim 10, wherein the angle between the side bearing surfaces is between 10-60 degrees.

12. The wear member of claim 1 wherein the rear bearing surface is curved in a side-to-side direction.

13. The wear member of claim 1, wherein the side bearing surfaces are planar.

14. A wear member for earth working equipment comprising at least one leg and a mounting configuration which together define a cavity to receive a base of the earth working equipment, the at least one leg extends rearwardly over the base, and the mounting configuration is proximate a front of the cavity, wherein the mounting configuration includes a pair of laterally-spaced, rearwardly converging side bearing surfaces and a rear bearing surface between the side bearing surfaces, the side bearing surfaces and the rear bearing surface each bear against a complementary support of the base on which the wear member is mounted, the rear bearing surface is curved in a vertical direction away from the at least one leg to define a curved upper profile and a curved lower profile, and one of the upper or lower profiles has a tighter curvature than the other of the upper or lower profiles.

15. The wear member of claim 14 including a pair a spaced apart legs to define the cavity to receive the base.

16. The wear member of claim 14, wherein the upper profile has a tighter curvature than the lower profile.

17. The wear member of claim 14, wherein the lower profile has a tighter curvature than the upper profile.

18. The wear member of claim 14, wherein the at least one leg includes a hole for receiving a lock to secure the wear member to the base, and at least part of the rear bearing surface in a side-to-side direction conforms to a radius of curvature that originates at a location that aligns with the hole.

19. The wear member of claim 14, wherein the upper profile is defined at least in part by one or more upper radius of curvature, the lower profile is defined at least in part by one or more lower radius of curvature, and at least one said upper radius of curvature is smaller than any said lower radius of curvature.

20. The wear member of claim 14, wherein the upper profile is defined at least in part by one or more upper radius of curvature, the lower profile is defined at least in part by one or more lower radius of curvature, and at least one said upper radius of curvature is larger than any said lower radius of curvature.

21. The wear member of claim 1, wherein the side bearing surfaces converge in a forward direction.

22. The wear member of claim 1, wherein the side bearing surfaces converge in a rearward direction.

23. The wear member of claim 14, wherein the rear bearing surface has a concave configuration in a side-to-side direction.

24. The wear member of claim 14, wherein the rear bearing surface has a convex configuration in a side-to-side direction.

25. The wear member of claim 14, wherein the at least one leg includes a hole for receiving a lock to secure the wear member to the base, and at least part of the rear bearing surface in a side-to-side direction conforms to a radius of curvature that originates at a location which aligns with the hole.

26. A wear member for earth working equipment comprising at least one leg and a mounting configuration which together define a cavity for receiving a base of the earth working equipment, the at least one leg extends rearwardly over the base, and the mounting configuration is at a front of the cavity, wherein the mounting configuration includes a pair of side bearing surfaces and a rear bearing surface, the side bearing surfaces and the rear bearing surface each bear against a complementary support of the base on which the wear member is mounted, the side bearing surfaces converge toward each other so as to face generally in both a rear direction and a transverse direction, and the rear bearing surface faces generally in a rear direction and has a curved, concave configuration in a side-to-side direction.

27. The wear member of claim 26 including a pair a spaced apart legs to define the cavity to receive the base.

28. The wear member of claim 26, wherein the side bearing surfaces converge in a rearward direction, and the rear bearing surface is between the side bearing surfaces.

29. The wear member of claim 26, wherein the rear bearing surface includes a pair of spaced rear bearing segments, and the side bearing surfaces converge in a forward direction between the rear bearing segments.

30. The wear member of claim 29, wherein each of the rear bearing segments has a concave, curved configuration.

31. A digging edge of an earth working equipment comprising an inner surface, an outer surface, a leading surface, and a support on the leading surface for bearing against a wear member mounted on the digging edge, the support including two converging lateral bearing surfaces and a forwardly-facing front bearing surface, wherein the lateral bearing surfaces define a gap extending from the inner surface to the outer surface to receive a portion of the wear member, and the front bearing surface has a curved, convex shape in a side-to-side direction.

32. The digging edge of claim 31, wherein the front bearing surface is between the lateral bearing surfaces, and the lateral bearing surfaces converge in a rearward direction.

33. The digging edge of claim 31, wherein the front bearing surface includes two spaced front bearing segments, and the lateral bearing surfaces converge in a forward direction between the front bearing segments.

34. The digging edge of claim 31 including a hole for receiving a lock to secure the wear member to the digging edge, wherein at least part of the front bearing surface in a side-to-side direction conforms to a radius of curvature that originates in the hole.

35. The digging edge of claim 31, wherein the front bearing surface is curved in a direction from the inner surface to the outer surface so as to define a curved upper profile and a curved lower profile, and wherein the one of the upper or lower profiles has a tighter curvature than the other of the upper or lower profiles.

36. The digging edge of claim 31, wherein each of the lateral bearing surfaces is planar.

37. A digging edge of an earth working equipment comprising an inner surface, an outer surface, a leading surface, and a support on the leading surface for bearing against a wear member mounted on the digging edge, the support including a pair of laterally-spaced, rearwardly converging lateral bearing surfaces and a front bearing surface between the lateral bearing surfaces, wherein the lateral bearing surfaces define a gap extending from the inner surface to the outer surface to receive a portion of the wear member, and the front bearing surface is curved in a direction from the inner surface to the outer surface so as to define a curved upper profile and a curved lower profile, and one of the upper or lower profiles has a tighter curvature than the other of the upper or lower profile.

38. The digging edge of claim 37, wherein the upper profile has a tighter curvature than the lower profile.

39. The digging edge of claim 37, wherein the lower profile has a tighter curvature than the upper profile.

40. The digging edge of claim 37, wherein the support includes a pair of laterally-inclined lateral bearing surfaces each facing in both a forward direction and a transverse direction.

41. The digging edge of claim 40, wherein the lateral bearing surfaces converge in a rearward direction, and the front bearing surface is between the lateral bearing surfaces.

42. The digging edge of claim 40, wherein the front bearing surface includes a pair of spaced front bearing segments, and the lateral bearing surfaces converge in a forward direction between the front bearing segments.

43. The digging edge of claim 42, wherein each of the front bearing segments has a convex, curved configuration.

44. A digging edge assembly for earth working equipment comprising:

a digging edge including an inner surface, an outer surface, a leading surface, and a support proximate the leading surface, the support including two converging lateral bearing surfaces and a front bearing surface, wherein the lateral bearing surfaces extend farther forward than the front bearing surface and converge toward each other so as to face generally in both a front direction and a transverse direction, and the front bearing surface is convex in a side-to-side direction;

a wear member including a pair of spaced apart legs defining a cavity therebetween that receive the digging edge, each of the legs extending rearwardly over the digging edge, and a mounting configuration proximate a front of the cavity to bear against the support, wherein the mounting configuration includes a pair of side bearing surfaces to bear against the lateral bearing surfaces and a rear bearing surface to bear against the front bearing surface, the side bearing surfaces extend farther forward than the rear bearing surface and converge toward each other so as to face generally in both a rear direction and a transverse direction, and the rear bearing surface faces generally in a rear direction and has a concave configuration; and a retainer to secure the wear member to the digging edge.

45. An insert for installation onto a digging edge of a bucket for earth working equipment, the insert comprising a main body and two forwardly projecting arms, wherein a front surface of the main body extends from one arm to the other arm so as to be curved and convex in a side-to-side direction extending between the two arms, each of the arms includes an inward facing lateral bearing surface, the lateral bearing surfaces diverge in a direction away from the front surface, the front surface is curved between the arms in a direction transverse to the side-to-side direction so as to define an upper curved profile and a lower curved profile, one of the upper or lower curved profiles has a tighter curvature than the other of the upper or lower curved profiles, and the front surface and the lateral bearing surfaces collectively define a gap to receive a wear member that bears against the front surface and the later bearing surfaces during a digging operation.

46. The digging edge of claim 31, wherein the lateral bearing surfaces converge toward the front bearing surface.

47. A wear member for earth working equipment comprising at least one leg and a mounting configuration which together define a cavity to receive a base of the earth working equipment, the at least one leg extends rearwardly over the base, and the mounting configuration is proximate a front of the cavity to bear against a complementary support of the base on which the wear member is mounted, wherein the mounting configuration includes a pair of laterally-spaced side bearing surfaces and a rear bearing surface extending between the side bearing surfaces, the rear bearing surface is concave in a side-to-side direction between the side bearing surfaces, the at least one leg includes a hole for receiving a lock to secure the wear member to the base, and at least part of the rear bearing surface in a side-to-side direction conforms to a radius of curvature that originates at a location aligned with the hole.

48. A wear member for earth working equipment comprising at least one leg and a mounting configuration which together define a cavity to receive a base of the earth working equipment, the at least one leg extends rearwardly over the base, and the mounting configuration is proximate a front of the cavity to bear against a complementary support of the base on which the wear member is mounted, wherein the mounting configuration includes a pair of laterally-spaced side bearing surfaces and a rear bearing surface extending between the side bearing surfaces, the rear bearing surface is concave in a side-to-side direction between the side bearing surfaces, the at least one leg includes a hole for receiving a lock to secure the wear member to the base, and the side bearing surfaces converge in a rearward direction at an angle where extensions of the two inner bearing surfaces intersect each other at a location aligned with the hole.

49. A wear member for earth working equipment comprising at least one leg and a mounting configuration which together define a cavity to receive a base of the earth working equipment, the at least one leg extends rearwardly over the base, and the mounting configuration is proximate a front of the cavity to bear against a complementary support of the base on which the wear member is mounted, wherein the mounting configuration includes a rear bearing surface curved in a vertical direction away from the at least one leg to define a curved upper profile and a curved lower profile, one of the upper or lower profiles has a tighter curvature than the other of the upper or lower profiles, the at least one leg includes a hole for receiving a lock to secure the wear member to the base, and at least part of the rear bearing surface in a side-to-side direction conforms to a radius of curvature that originates at a location that aligns with the hole.

50. A wear member for earth working equipment comprising at least one leg and a mounting configuration which together define a cavity to receive a base of the earth working equipment, the at least one leg extends rearwardly over the base, and the mounting configuration is proximate a front of the cavity to bear against a complementary support of the base on which the wear member is mounted, wherein the mounting configuration includes a rear bearing surface curved in a vertical direction away from the at least one leg to define a curved upper profile and a curved lower profile, wherein one of the upper or lower profiles has a tighter curvature than the other of the upper or lower profiles, the at least one leg includes a hole for receiving a lock to secure the wear member to the base, and at least part of the rear bearing surface in a side-to-side direction conforms to a radius of curvature that originates at a location which aligns with the hole.

51. A digging edge of an earth working equipment comprising an inner surface, an outer surface, a leading surface, a hole for receiving a lock to secure the wear member to the digging edge, and a support proximate the leading surface for bearing against a wear member mounted on the digging edge, the support including two converging lateral bearing surfaces and a forwardly-facing front bearing surface, wherein the front bearing surface has a convex shape in a side-to-side direction, and at least part of the front bearing surface in a side-to-side direction conforms to a radius of curvature that originates in the hole.

* * * * *